US007991342B2

(12) United States Patent
Kabata et al.

(10) Patent No.: US 7,991,342 B2
(45) Date of Patent: Aug. 2, 2011

(54) PROTECTIVE MATERIAL AND IMAGE FORMING APPARATUS USING THE PROTECTIVE MATERIAL

(75) Inventors: Toshiyuki Kabata, Yokohama (JP); Kumiko Hatakeyama, Sagamihara (JP); Kunio Hasegawa, Isehara (JP); Shinya Tanaka, Sagamihara (JP); Masahide Yamashita, Tokyo-to (JP); Masato Iio, Yokohama (JP); Hiroshi Nakai, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 228 days.

(21) Appl. No.: 12/435,511

(22) Filed: May 5, 2009

(65) Prior Publication Data

US 2009/0279930 A1 Nov. 12, 2009

(30) Foreign Application Priority Data

May 7, 2008 (JP) ..... 2008-121141

(51) Int. Cl.
*G03G 15/00* (2006.01)
*G03G 21/00* (2006.01)

(52) U.S. Cl. ..... 399/346; 399/123; 399/343; 15/1.51; 15/256.51

(58) Field of Classification Search ..... 399/123, 399/343–346; 15/1.51, 256.5, 256.51
See application file for complete search history.

(56) References Cited

U.S. PATENT DOCUMENTS

| | | | | |
|---|---|---|---|---|
| 3,501,294 | A | 3/1970 | Joseph | |
| 2005/0191099 | A1* | 9/2005 | Yamaguchi et al. | 399/346 |
| 2006/0269323 | A1* | 11/2006 | Kabata et al. | 399/159 |
| 2007/0166087 | A1* | 7/2007 | Yamaguchi et al. | 399/346 |
| 2008/0089726 | A1 | 4/2008 | Hatakeyama et al. | |
| 2008/0118286 | A1 | 5/2008 | Yamashita et al. | |

FOREIGN PATENT DOCUMENTS

| | | |
|---|---|---|
| JP | 51-22380 | 7/1976 |
| JP | 9-90847 | 4/1997 |
| JP | 9-138622 | 5/1997 |
| JP | 10-279998 | 10/1998 |
| JP | 2000-319224 | 11/2000 |
| JP | 2000-338819 | 12/2000 |
| JP | 2002-6679 | 1/2002 |
| JP | 2006-84878 | 3/2006 |
| JP | 2007-140391 | 6/2007 |

* cited by examiner

*Primary Examiner* — David P Porta
*Assistant Examiner* — Jessica L Eley
(74) *Attorney, Agent, or Firm* — Oblon, Spivak, McClelland, Maier & Neustadt, L.L.P.

(57) ABSTRACT

A protective material block including a metal soap, wherein the surface of the protective material block has an X-ray diffraction pattern wherein a ratio (P2/P1) of a maximum peak height (P2) on a surface separation of from 3.6 to 5.0 Å to a maximum peak height (P1) on a surface separation of from 11 to 16 Å not greater than 0.5.

20 Claims, 6 Drawing Sheets

PROTECTIVE MATERIAL AND IMAGE FORMING APPARATUS USING THE PROTECTIVE MATERIAL

BACKGROUND OF THE INVENTION

1. Field of the Invention

The present invention relates to a protective material protecting the surface of a photoreceptor used for electrophotographic image forming and an image forming apparatus using the protective material.

2. Discussion of the Background

In an electrophotographic image forming apparatus, an image bearer such as a photoconductive photoreceptors is subjected to a charging process, an irradiating process, a developing process and transferring process to form an image. Discharge products produced in the charging process, remaining on the surface of the photoreceptor and residual toners or toner components remaining thereon after the transferring process are removed in a cleaning process.

Conventional cleaning methods use an inexpensive and simple cleaning blade formed of a rubber or urethane, having good cleanability. However, since the cleaning blade is pressed to the surface of a photoreceptor to remove residues thereon, a stress due to friction between the surface of a photoreceptor and the cleaning blade is large and the cleaning blade and the photoreceptor, particularly an organic photoreceptor, are abraded, resulting in shorter lives thereof. In addition, a toner used for forming images is having a smaller particle diameter to produce higher quality images. The smaller the particle diameter, the more the toner scrapes through a cleaning blade. Particularly when the cleaning blade has insufficient dimensional accuracy, assemble accuracy or partially oscillates, the toner scrapes through the blade more, resulting in production of poor quality images.

So as to extend the life of an organic photoreceptor to produce high quality images for long periods, deterioration of members such as a cleaning blade due to abrasion needs to be reduced to improve cleanability thereof.

Japanese published examined application No. 51-22380 discloses a method of pulverizing a metal soap block such as zinc stearate by pressing a brush thereto to prepare a powder, applying the powder to a photoreceptor, and forming a film of a lubricant thereover with a cleaning blade.

The metal soap such as zinc stearate improves the lubricity of the surface of a photoreceptor to reduce the friction between the photoreceptor and the cleaning blade and improve the cleanability of an untransferred toner.

In the charging process, a DC voltage has been overlapped with an AC voltage to charge a photoreceptor with a charging roller (AC charge). This uniformly charges a photoreceptor, less produces oxidized gas such as ozone and NOx, and downsizes the apparatus. However, deterioration of the surface of a photoreceptor is accelerated by repeated discharges between a charger and the photoreceptor because positive and negative discharges therebetween repeat for several hundred to thousand times a second according to the frequency of the AC voltage applied to the photoreceptor. When a photoreceptor is coated with a lubricant, the charging energy is absorbed by the lubricant first and difficult to reach the photoreceptor, and which is protected.

The metal soap resolves with the energy, but does not completely resolve and disappear. A low-molecular-weight fatty acid is produced and friction between the photoreceptor and cleaning blade is likely to increase. A toner is likely to adhere to the photoreceptor in the form of a film with a fatty acid, resulting in deterioration of image resolution, abrasion of the photoreceptor and uneven image density.

Therefore, it is necessary to apply a large amount of the metal soap onto a photoreceptor to cover the surface thereof with the metal soap instantly even when the fatty acid is produced. Further, the linear speed of a photoreceptor increases to meet demands for forming images at higher speed, and the amount of the metal soap applied thereto needs increasing accordingly.

The metal soap block for use in image forming apparatus is typically prepared by casting melted metal soap into a mold and cooling as disclosed in Japanese published unexamined application No. 10-279998. Since the thus prepared metal soap block has an isotropic and precise crystal, the durability of a brush is not sufficient because of being pressed to the metal soap at higher pressure to apply a large amount of the metal soap to a photoreceptor having a high linear speed.

The particulate metal soap scraped by the brush is an amorphous granulated fine powder. The particulate metal soap is dammed, pulverized and coated on a photoreceptor by the blade while the linear speed thereof is low. However, when the metal soap is applied much and the linear speed of a photoreceptor is high, comparatively a large particulate metal soap passes the blade and reached the charging roller. The particulate metal soap electrostatically adheres to the charging roller, and is oxidized and melted with the charging energy, and finally fixed thereon. When the metal soap is fixed on the charging roller, the metal soap involves a toner present on a photoreceptor and a part of the charging roller the metal soap is fixed on has high resistivity, resulting in defective charging and production of images having black stripes.

Japanese published unexamined application No. 2000-319224 discloses a method of casting a metal soap into a mold heated to have a temperature lower than a melting point of the metal soap by 25 to 45° C. and compacting the metal soap under reduced pressure to prepare a metal soap block without crack and defect. This method covers an energy for a temperature lower than the melting point with a compression energy and eliminates an airspace in the metal soap block with depressurization to prepare a metal soap block which is almost the same one prepared by melting. However, when the metal soap is applied much and the linear speed of a photoreceptor is high, comparatively a large particulate metal soap passes the blade and reached the charging roller. The particulate metal soap electrostatically adheres to the charging roller, and is oxidized and melted with the charging energy, and finally fixed thereon. When the metal soap is fixed on the charging roller, the metal soap involves a toner present on a photoreceptor and a part of the charging roller the metal soap is fixed on has high resistivity, resulting in defective charging and production of images having black stripes.

In order to solve this problem in coating the metal soap on a photoreceptor, many suggestions are made.

Japanese published unexamined application No. 2007-140391 discloses a method of coating a metal soap with a coating roller on a photoreceptor and evening the metal soap thereon with a leveling blade having a specific or more hardness. not less than a specific hardness.

However, as shown in FIG. 4 in Japanese published unexamined application No. 2007-140391, particulate metal soaps having various sizes are present. Therefore, the leveling blade needs to have comparatively a high hardness to form a uniform lubricant layer and a pressure of the brush is precisely controlled to uniformly scrape the metal soap.

Namely, when the amount of the metal soap applied to a photoreceptor varies, particularly when it decreases, the blade having high hardness gives a large stress thereto, resulting in scratches thereof and abrasion of the blade.

Japanese published unexamined application No. 2006-84878 a method of contacting a flicking member to a brush when scraping and applying a metal soap block with a brush-shaped application member to surface of a photoreceptor to uniformly apply the metal soap thereto.

However, the scraped metal soaps still have various sizes and are not necessarily applied to a photoreceptor in the width direction.

Japanese published unexamined applications Nos. 2002-6679, 9-90847 and 9-138622 disclose methods of stabilizing an amount of the metal soap block applying to a photoreceptor. However, since additional members such as a metal soap oscillator, a cutter and a thermodetector are needed to stabilize an amount of the metal soap block applying to a photoreceptor, the mechanism and control are complicated.

Japanese published unexamined application No. 2000-338819 discloses a method of stabilizing an amount of the metal soap block applying to a photoreceptor over time. However, this does not consider at all the size of the scraped particulate metal soap and resolve positional unevenness of the amount of the metal soap block applying thereto.

Because of these reasons, a need exists for a protective material block protecting a photoreceptor even when rotating at high speed and capable of producing high-quality images without black stripes due to high resistivity of a charging roller.

SUMMARY OF THE INVENTION

Accordingly, an object of the present invention is to provide a protective material block protecting a photoreceptor even when rotating at high speed and capable of producing high-quality images without black stripes due to high resistivity of a charging roller.

Another object of the present invention is to provide an image forming apparatus using the protective material block.

These objects and other objects of the present invention, either individually or collectively, have been satisfied by the discovery of a protective material block comprising a metal soap, wherein the surface of the protective material block has an X-ray diffraction pattern wherein a ratio (P2/P1) of a maximum peak height (P2) on a surface separation of from 3.6 to 5.0 Å to a maximum peak height (P1) on a surface separation of from 11 to 16 Å not greater than 0.5.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
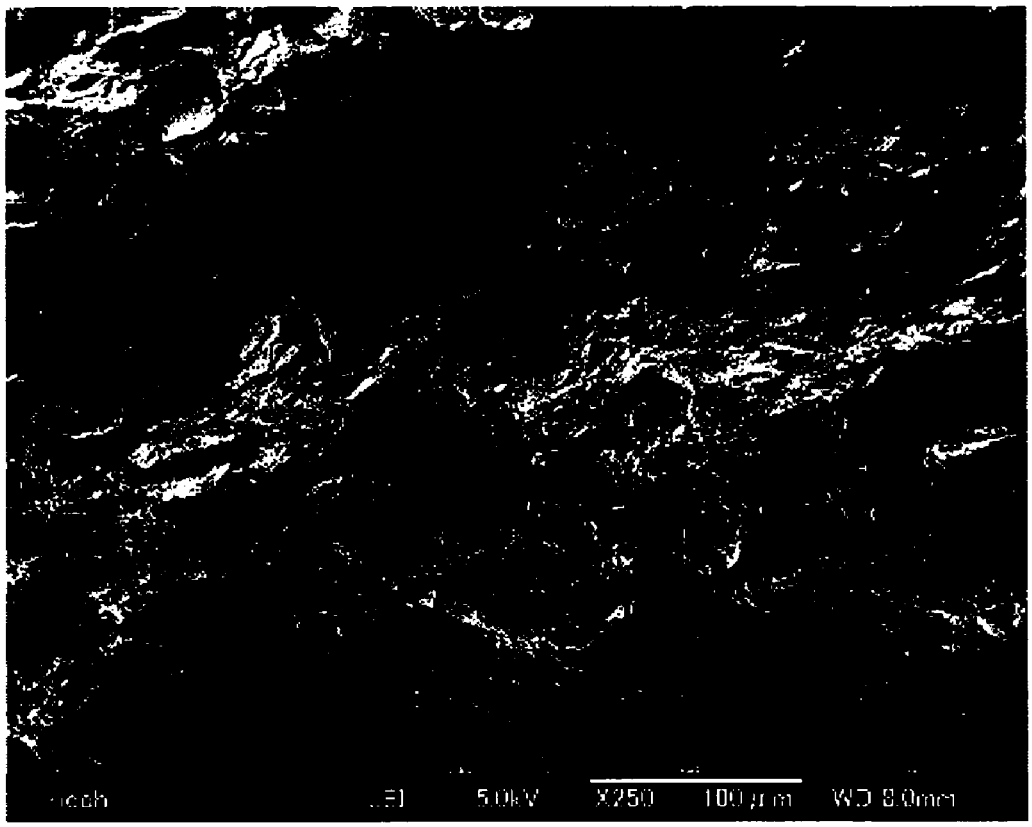
FIG. 1 is a scanning electron microscope (SEM) picture of a split face of the split protective material block of the present invention.

The present inventors studied a method of steadily coating a metal soap on a photoreceptor even when the linear speed thereof is high and preventing the particulate metal soap from flying to a charging roller even when passing the blade.

The metal soap coated on a photoreceptor when rotating at a low linear speed is orientedly present, e.g., zinc stearate is said to be stable in a bimolecular layer. When a photoreceptor rotates at a high linear speed, the zinc stearate covering the photoreceptor is present in a bimolecular layer, but in places the zinc stearate not covering or insufficiently covering, randomly directed molecules, more than bimolecular molecular layers or no molecule is present.

Marketed particulate metal soaps has molecules randomly directed and not oriented at all.

When a metal soap is used in image forming apparatus, the metal soap is melted and cooled to prepare a metal soap block as mentioned above, and a brush is pressed to the metal soap block and rotated to pulverize the metal soap to apply the resultant particulate metal soap to a photoreceptor. Molecules of the particulate metal soap applied to a photoreceptor is not oriented, but are strongly pressed by the blade to the photoreceptor to form a bimolecular layer thereon and are oriented.

The present inventors considered that as a particulate metal soap having randomly directed molecules which is not oriented passes the blade and adheres to a photoreceptor or cannot be oriented thereon when the photoreceptor rotates at high liner speed, it cannot cover the photoreceptor. Therefore, they discovered that a photoreceptor is steadily coated when the particulate metal soap is oriented.

The present invention provides a protective material block protecting a photoreceptor even when rotating at high speed and capable of producing high-quality images without black stripes due to high resistivity of a charging roller. More particularly, the present invention relates to a protective material block comprising a metal soap, wherein the surface of the protective material block has an X-ray diffraction pattern wherein a ratio (P2/P1) of a maximum peak height (P2) on a surface separation of from 3.6 to 5.0 Å to a maximum peak height (P1) on a surface separation of from 11 to 16 Å not greater than 0.5.

It is not clear which part of the protective material the peak on a surface separation of from 11 to 16 Å in the diffraction pattern of the protective material block of the present invention corresponds to. However, the thickness of a metal soap coated in a bimolecular layer on a photoreceptor is approximately 11 to 16 Å when measured by SPM or some other methods, and is possibly equivalent to an interstitial distance between two molecules of the metal soap. Namely, a peak present on a surface separation of from 11 to 16 Å means a bimolecular layer of the metal soap which can stably be coated on a photoreceptor is formed on the whole protective material block. It is not clear which part of the protective material the peak on a surface separation of from 3.6 to 5.0 Å corresponds to, either, but the surface separation is thought equivalent to a molecule of the metal soap or an interstitial distance corresponding to a length of the fatty acid part of the metal soap.

A ratio (P2/P1) of a maximum peak height (P2) on a surface separation of from 3.6 to 5.0 Å to a maximum peak height (P1) on a surface separation of from 11 to 16 Å is not greater than 0.5, preferably not greater than 0.4, and more preferably not greater than 0.3. The smaller the ratio (P2/P1), the more stably the protective material block is coated on a photoreceptor even when having a higher linear speed. When the ratio (P2/P1) is greater than 0.5, the protective material is difficult to coat on a photoreceptor, likely to pass the blade and adhere to the charging roller, resulting in production of striped abnormal images.

The protective material block of the present invention is prepared by compact casting or melt casting. The compact casting is more suitable for preparing the protective material block having high orientation of the present invention. The melt casting is difficult to form a protective material block because of needing melting a protective material mainly formed of a metal soap and quickly cooling the melted protective material while forming a flow thereof or applying a force such as a centrifugal force there to in a specific direction.

The compact casting can prepare a protective material block having high orientation with comparative ease. A particulate metal soap is not typically oriented just after synthesized. The melted particulate metal soap is not oriented even when slowly and calmly cooled. However, when a strong pressure is applied to a particulate metal soap, the particulate metal soap is crushed, flattened and oriented. The metal soap keeps oriented, and crushed and flattened even when released from the pressure. Therefore, the compact casting can prepare a protective material block having high orientation.

The particulate metal soap used for preparing a protective material block by compact casting has a particle diameter of from 1 to 200 μm, preferably from 5 to 150 μm, and more preferably from 10 to 100 μm. When less 1 μm, the particulate metal soap is likely to flow out from a casting mold and a protective material block having a desired shape is difficult to prepare. When greater than 200 μm, a pressure is difficult to apply to the whole particulate metal soap, and which has low orientation, resulting in insufficient coverage of the protective material over a photoreceptor.

When the protective material block of the present invention is prepared by compact casting, the strength and orientation of the protective material block vary according to a degree of compaction. The protective material block of the present invention is compacted at from 82 to 99%, and preferably from 85 to 98% of a true specific gravity of all the protective material. When lower than 82%, the protective material block lowers in mechanical strength and orientation. When greater than 99%, a compacting machine needs to have high capacity and the resultant protective material block partially melts due to a compacting pressure, deteriorates in orientation and largely differentiates in hardness partially.

When the protective material block is prepared by compact casting, the particulate metal soaps are preferably lined up in the same direction to increase the orientation. After the particulate metal soaps are placed in a casting mold, they are preferably compacted uniformly in the same direction while vibration such as ultrasonic is applied to them. In addition, they are preferably compacted upon application of pressure at many stages because of less flowing out from a casting mold.

The protective material block compacted at from 88 to 98% of a true specific gravity of all the protective material can be pulverized with a pressure of the brush lower than a pressure to the protective material block prepared by melt casting. Therefore, the brush can stably apply a protective material to a photoreceptor without deterioration with age.

Specific examples of the metal soap used for the protective material block include compounds formed of long-chain alkyl carboxylic acid salts, etc. having an anion at the end of hydrophobic site such as a lauric acid salt, a myristic acid, a palmitic acid salt, a stearic acid salt, a behenic acid salt, a lignoceric acid salt, a cerinic acid salt, a montanic acid salt and a mellisic acid salt bonded with alkaline metal ions such as sodium and kalium, alkaline earth metal ions such as magnesium and calcium, and metal ions such as aluminum and zinc. Specific examples thereof include zinc stearate, calcium stearate, magnesium stearate, zinc laurate, magnesium laurate, zinc palmitate, etc. These can be used alone or in combination. Among these, zinc stearate, zinc palmitate and a mixture thereof are preferably used because of having good film formability and protectability. The mixture of zinc stearate and zinc palmitate is more preferably used.

The zinc stearate and the zinc palmitate are both aliphatic metallic salts, and the zinc stearate has 18 carbon atoms and the zinc palmitate has 16 carbon atoms at aliphatic sites, respectively. Therefore, the zinc stearate and the zinc palmitate have similar structures, are compatible with each other and behave as almost same materials and both protect a photoreceptor.

When a photoreceptor has a higher linear speed, a charged energy, a particularly the AC charged energy, applied to the photoreceptor becomes stronger and a protective material thereon needs to have a larger thickness to increase the protectability thereof.

It is said that the zinc stearate does not randomly adhere to the photoreceptor and stably adheres thereto bimolecularly. Namely, even when the zinc stearate is applied to the photoreceptor, it is saturated when having its bimolecular thickness. When the zinc palmitate having a slightly shorter molecule than the zinc stearate is combined therewith, the molecular layer does not have a fixed height and lower and higher parts come to coexist. A following molecule enters the lower part to form a molecular layer. As a result, a protective material layer having a thickness larger than that of the bimolecular layer and the photoreceptor is more effectively protected. When the zinc palmitate is too much, a bimolecular layer of the zinc palmitate is likely to form and the protective material does not thicken. Instead, since the zinc palmitate is smaller than the zinc stearate, a photoreceptor is less protected than the zinc stearate alone.

The mixture of zinc stearate and zinc palmitate deteriorates the orientation of the resultant protective material, and which is difficult to coat on a photoreceptor. When a photoreceptor has a high linear speed, a protective material block of the present invention having high orientation has to be used.

When the mixture of zinc stearate and zinc palmitate is used as a protective material of the present invention, they may be mixed each in the form of powder. However, the zinc stearate and the zinc palmitate are likely to be eccentrically-located on a photoreceptor, each having a specific size. Therefore, the zinc stearate and the zinc palmitate are preferably compatible with each other in a particle. Methods of making the zinc stearate and the zinc palmitate compatible with each other in a particle include a method of melting and mixing them to prepare a mixture, and cooling and pulverizing the mixture to prepare a powder in which the zinc stearate and the zinc palmitate are compatible with each other; and a conventional dry or wet method used for preparing a metallic soap with a mixture of a predetermined amount of each of the zinc stearate and the zinc palmitate to prepare a powder in which they are compatible with each other. Particularly, a ratio between the zinc stearate and the zinc palmitate as a material in the mixture of a predetermined amount of each thereof remains almost same in the resultant product, and not only the zinc stearate and the zinc palmitate are perfectly compatible with other but also the reproducibility and productivity is very high.

A ratio between the zinc stearate and the zinc palmitate in a protective material block may be determined by amounts of their materials, however, is preferably measured per lot because the materials definitely includes impurities. The ratio can be measured by dissolving a protective material block in a hydrochloric acid-methanol solution; heating the solution to methylate the stearic acid and palmitic acid at 80° C.; measuring a ratio between the stearic acid and palmitic acid by gas chromatography; and exchanging the ratio into a ratio between the zinc stearate and the zinc palmitate.

A mixing ratio by weight of the zinc stearate to the zinc palmitate for use in the protective material block of the present invention is preferably from 75/25 to 40/60, more preferably from 66/34 to 40/60, and furthermore preferably from 65/45 to 45/55. When the zinc stearate is greater than 75% by weight, the protective material is difficult to coat on a photoreceptor. When the zinc palmitate is greater than 60% by weight, a photoreceptor is less protected from the AC charged energy.

The protective material for use in the image forming apparatus of the present invention may include other different metal soaps beside the zinc stearate and zinc palmitate. However, it is preferable not to use metal soaps having constitutions largely different from those of the zinc stearate and zinc palmitate because of possibly disturbing a protection layer formed thereby on a photoreceptor. Metal soaps having constitutions similar to those thereof (fatty acid zinc soaps having 13 to 20 carbon atoms) are preferably used.

The protective material for use in the image forming apparatus of the present invention preferably includes self-lubricating talc and/or boron nitride in the mixture of the zinc stearate and the zinc palmitate to maintain lubricity of a photoreceptor. Particularly, the boron nitride has high lubricity because of having a graphite structure and is chemically stable. The protective material preferably includes talc and/or boron nitride in an amount of from 1 to 25% by weight, more preferably from 2 to 23%, and furthermore preferably from 3 to 21% by weight based on total weight of protective material. When less than 1% by weight, self-lubrication of talc and/or boron nitride does not work. When greater than 25% by weight, talc and/or boron nitride thickly accumulate on a photoreceptor, resulting in deterioration of the sensitivity of a photoreceptor.

The protective material may include inorganic particulate materials such as silica, alumina, zirconia, clay and calcium carbonate and their surface-hydrophobized particulate materials; and organic particulate materials such as particulate methyl polymethacrylate, particulate polystyrene, particulate silicone resin and particulate α-olefin-norbornene copolymer resin. These particulate materials do not have an effect of protecting a photoreceptor but have an effect of leveling a protective material adhering to a photoreceptor too much. Particularly, the alumina is preferably used because of not deteriorating the sensitivity of a photoreceptor. The alumina preferably has a particle diameter of from 0.05 to 2 μm, more preferably from 0.10 to 1 μm, and furthermore preferably from 0.15 to 0.7 μm.

Besides, as a supplement for increasing affinity between the protective material and the surface of a photoreceptor and assisting formation of the protective material layer, an amphipathic organic compound such as a surfactant may be added to the protective material.

Since it is possible that the amphipathic organic compound may largely change the surface property of a main material, the protective material preferably includes the amphipathic organic compound in an amount of from 0.01 to 3% by weight, and more preferably from 0.05 to 2% by weight.

The protective material block is attached to a substrate such as metals, metal alloys and plastics with an adhesive, etc.

The X-ray diffraction pattern of the protective material block of the present invention is measured by X-ray diffraction apparatus X' Pert PRO from Philips under the following conditions:

X-ray source: Cu—Kα

Wavelength of Kα1: 1.54056 Å

Wavelength of Kα2: 1.54439 Å

Kα2/Kα1: 0.5

Scan width (2θ): 5~100°

Step width (2θ): 0.02°

Voltage of X-ray dry bulb: 40 kV

Current of X-ray dry bulb: 40 mA

Incident, receiver slit: 1°

Smoothing: Nil

The protective material block of the present invention has at least a cleavage surface, preferably plural cleavage surfaces, and more preferably 10 or more cleavage surfaces per 1 $mm^2$ although depending on the size thereof. The protective material block having at least a cleavage surface provides a particulate metal soap larger than a metal soap formed by melt casting to a photoreceptor when a brush is pressed to the protective material block and rotated. However, the particulate metal soap has the shape of a thin scale and is provided to a photoreceptor and easily extended by a blade.

This is because the thinly-extended particulate metal soap is peeled with ease along the cleavage surface, extended by a blade and smoothly coat a photoreceptor, and almost no articulate metal soap scrapes through.

In the present invention, the cleavage surface of a protective material is a part which is partly flat when split. This is one of the particulate protective material flattened with pressure. Therefore, each of the cleavage surfaces has a limited area.

Specific examples of methods of splitting the protective material block include, but are not limited to, (1) cutting with a knife, a saw, a heating wire, etc., (2) hit with a hammer, etc., (3) placing a supporting point under the protective material block and pressing it below at two points apart from the supporting point, (4) holding the protective material block at two points and moving them in different directions, etc. However, (1) cutting and (2) hitting are not preferably used because of forming a cross-section while breaking the cleavage surface, and (3) and (4) are preferably used. Just 1 $mm^2$ of the cleavage surface has only to be observed, the cleavage surface of the protective material block split from a scratch can preferably be observed.

The cleavage surface of the protective material block may be random. However, the protective material block preferably has many cleavage surfaces along a face where the protective material block and a brush as a protective material applicator are facing each other. The protective material having many cleavage surfaces on a face the brush is facing is likely to provide a scale-shaped protective material easily applicable on a photoreceptor thereto.

FIG. 1 is a scanning electron microscope (SEM) picture of a split face of the split protective material block of the present invention. As shown in FIG. 1, cleavage surfaces having an area of from 10 to 10,000 $\mu m^2$ are observed on almost all the cross-section of the protective material.

Each of the cleavage surfaces preferably has an area of from 10 to 10,000 $\mu m^2$, more preferably from 15 to 5,000 $\mu m^2$, and furthermore preferably from 20 to 10,000 $\mu m^2$. When less than 10 $\mu m^2$, amorphous protective material is more formed than scale-shaped protective material when scraped with a brush and the protective material is difficult to form on a photoreceptor. In addition, the particulate protective material passes a blade, flies to a charging roller and is firmly fixed thereon, possibly resulting in striped abnormal images. When greater than 10,000 $\mu m^2$, thick scale-shaped protective material is difficult to form on a photoreceptor, and the particulate protective material passes a blade, flies to a charging roller and is firmly fixed thereon, possibly resulting in striped abnormal images.

The cross-section of the protective material of the present invention when split inevitably has a melted part and cleavage surfaces having an area out of 10 to 10,000 $\mu m^2$. However, the cross-section preferably has cleavage surfaces having an area of from 10 to 10,000 $\mu m^2$ in an area not less than 50%, more preferably not less than 55%, and furthermore preferably of from 60 to 95%. When less than 50%, amorphous protective material ismore formed than scale-shaped protective material when scraped with a brush and the protective material is difficult to form on a photoreceptor. In addition, the particulate protective material passes a blade, flies to a charging roller and is firmly fixed thereon, possibly resulting in striped abnormal images. The other areas besides the cleavage surfaces having an area out of 10 to 10,000 $\mu m^2$ may be not cleavage surfaces, cleavage surfaces having an area less than 10 $\mu m^2$ or cleavage surfaces having an area greater than 10,000 $\mu m^2$.

The protective material block of the present invention is preferably a porous material having communicating pores having an interconnected bubble fraction of from 3 to 15% by volume and an independent bubble fraction of from 0 to 1% by volume. Such a porous protective material block not substantially having a closed inner space provides a protective material powder having an even particle diameter onto an image bearer when scraped with an applicator. Therefore, the protective material is stably and evenly provided thereon and for long periods.

Each of the interconnected bubble fraction and the independent bubble fraction is an indication of a ratio of a gas (typically air) in an apparent volume of the protective material block. The interconnected bubble fraction is a ratio of an airspace continuously connected with outside of the protective material block, and the independent bubble fraction is a ratio of an airspace separate from outside thereof.

These ratios are measured according to JIS K7138 "Hard foamed plastic-how to measure interconnected bubble fraction and independent bubble fraction".

It is preferable not to atomize the protective material block to measure each of the bubble fractions. They can precisely be measured if the protective material block having a length of approximately 3 cm.

In order to protect a photoreceptor, a protective material needs to be provided on the photoreceptor in a specific amount thereof and an fully even size. For that purpose, it is preferable that the provided amount and particle diameter does not depend on the property of the protective material block, and that the protective material block is a consolidated powder formed by pressing powdery protective material materials.

The protective material block keeps its structure by biding force mainly of inter particle cohesion while keeping materially discontinuity at an inter particle (grain) boundary of the protective material block. Such a protective material block is easily loosened to the original powder with comparatively a moderate force, and a protective material powder having a uniform particle diameter can be provided to a photoreceptor in a needed amount.

The protective material block of the present invention is mainly formed of a metal soap. The protective material powder having a uniform particle diameter is provided on the surface of a photoreceptor to quickly and uniformly form a protective film having good lubricity thereon.

The protective material block of the present invention preferably includes a particulate material having a number-average particle diameter (D1) of from 0.1 to 1.5 μm as a supplement in the process of forming or removing a protection layer. These particulate materials move rolling and sliding to thinly extend the protective material powder when extending and forming a protection layer to assist quickly forming a uniform protective material layer. The protective material having received electrical stress in the protective material layer is preferably removed as quickly as possible and replaced with a protective material not having received electrical stress.

The particulate material entangles the deteriorated protective material due to stress and quickly casts it out, and the protective material layer is very stably metabolized to stably protect an image bearer.

The protective material block of the present invention is preferably prepared by compacting a metal soap powder and a solid lubricant powder.

When a ratio (Db/Da) of a number-average 50% particle diameter of the solid lubricant powder (Db) to a number-average 50% particle diameter of the metal soap powder (Da) is greater than 0 and not greater than 0.4 and Db is from 0.1 to 14 μm, the uneven density of the protective material block can be fully controlled.

Specific examples of the particulate materials include, but are not limited to unless impairing the constitution of the present invention, particulate metal oxides and metal multiple oxides such as aluminum oxide, silicon oxide, titanium oxide, zirconium oxide, cerium oxide, strontium titanate and magnesium aluminometasilicate; particulate solid lubricants such as boron nitride, molybdenum disulfide and calcium fluoride; and organic particulate materials such as a particulate silicone resin and a particulate silicone rubber.

As other protective material materials, powder waxes are preferably used.

Specific examples of the waxes include hydrocarbons such as aliphatic saturated hydrocarbons, aliphatic unsaturated hydrocarbons, alicyclic saturated hydrocarbons and aromatic hydrocarbons; vegetable natural waxes such as carnauba waxes, rice bran waxes and Candellila waxes; animal natural waxes such as bees waxes and snow wax. These can be used alone or in combination.

Particularly, the aliphatic saturated hydrocarbons and alicyclic saturated hydrocarbons formed of only low-reactivity stable saturated bonding in the molecule are preferably used. Among them, hydrocarbon waxes such as normal paraffins, isoparaffins and cycloparaffins are preferably used because of being difficult to perform additional reaction, chemically stable and difficult to oxidize in the atmosphere.

Particularly, hydrocarbon waxes including at least one of Fischer-Tropsch wax and polyethylene wax as comparatively a hard wax are more preferably used to increase the durability of the protection layer without making the protection layer formed on the surface of an image bearer too thick.

As mentioned above, since the protective material layer formed on the surface of a photoreceptor is exposed to an electrical stress and deteriorated, a wax having too small a molecular weight does not execute a sufficient protective effect occasionally.

On the other hand, a wax having too large a molecular weight, a large shear stress is needed to form a protective material film on a photoreceptor and a uniform protective film is not formed occasionally.

The wax preferably has a weight-average molecular weight of from 350 to 850, and more preferably from 400 to 800 to execute a sufficient protective effect.

Besides, an amphiphatic organic compound such as a surfactant may be combined to increase affinity between the protective material and the surface of a photoreceptor and assist forming the protective material layer.

The protective material block of the present invention preferably has a scale parameter η of from 1.20 to 3.20 [N/mm$^2$] and a shape parameter m of from 5 to 15 when measured with wild plot of break strength by 3-point bend test. The feeding amount of the protective material block does not vary according to the width direction and is fully controlled. A protection layer having enough thickness is uniformly formed on the surface of an image bearer, which fully resists not only mechanical stress but also electrical stress and does not deteriorate for long periods. Therefore, an image forming apparatus including the image bearer is in good condition and stably produce quality images for long periods.

When the scale parameter η is less than 1.20 [N/mm$^2$], the protective material block is so brittle that it is likely to be provided too much and difficult to stably provide on the surface of a photoreceptor. In addition, even a slight influence such as image forming environment causes excess and deficiency of the protective material on the surface of a photoreceptor, resulting in difficulty of protecting the photoreceptor and stably producing quality images. When greater than 3.20 [N/mm$^2$], the protective material block has too large strength and is likely to be provided short, resulting in insufficient protective effect for a photoreceptor and a cleaning blade. In addition, a brush roller needs to have a large pressure to sufficiently provide the protective material, and a toner having passed the cleaning blade is caught by the brush and melts with friction heat when the brush strongly presses the protective material block to partially coat the protective material block, resulting in uneven provision thereof.

Further, the scale parameter η is more preferably from 1.60 to 2.60 [N/mm$^2$].

When the shape parameter m is less than 5, the protective material block possibly has large differences of brittleness in the width direction. Therefore, the amount fed thereof varies according to places, resulting in formation of an uneven protection layer on a photoreceptor. Further, the uneven protection layer causes production of images having uneven image density occasionally.

When the shape parameter m is greater than 15, the variation of the amount fed thereof according to places is prevented. However, the protective material needs to have uniform density to have a uniform bending strength such that the shape parameter m is greater than 15. The uniform density needs to have a very small porosity ϕ, and which hardens the protective material, resulting in difficulty of having good feedability.

Further, the shape parameter m is more preferably from 8 to 12.

The shape parameter m is closely related to the porosity ϕ and variation of the protective material, and when the porosity ϕ less than 3%, the protectivem aterial homogenizes, resulting in difficulty of making the shape parameter m not greater than 15. When the porosity ϕ is greater than 15%, the protective material includes local looseness and density, resulting in difficulty of making the shape parameter not less than 5.

The 3-point bend test is made on JIS K 7211-1 "Hard Foamed Plastic-Bend Test-Part 1: Bend Test". A test chip has a thickness of 8±0.2 mm, a width of 8±0.2 mm and a length of 60±6 mm. A distance between supporting points is 40 mm and a pressure shim has a radius of 3±0.2 mm. The scale parameter η and shape parameter m are determined based on Weibull distribution formula using a breaking load measured.

The scale parameter η and shape parameter mare indications of sample strength and variation of the strength, respectively. At least breaking load data of 10 points of a sample, and are determined by Kaplan-Meier method (product-method of limits) based on the following Weibull distribution formula (1):

$$S(t)=\exp(-(t/\eta)m) \quad (1)$$

wherein η is a scale parameter [N/mm$^2$], m is a shape parameter, t is a break strength [N/mm$^2$] and S(t) is a presence rate up to the break strength t.

The break strength t is determined by the following formula (2):

$$t=3\times9.8\times10-3\times F\times L/(2\times w\times d2) \quad (2)$$

wherein F is a breaking load [g], L is a distance between supporting points [mm], w is a width of a chip [mm] and d is a thickness [mm].

The protective material block of the present invention executes a good effect when providing the protective material to a photoreceptor.

In addition, the protective material block of the present invention is preferably used to protect an intermediate transferer such as an intermediate transfer belt and an intermediate transfer roller.

A protective material applicator applying the protective material block of the present invention for an image forming apparatus preferably includes at least a protective material application member applying the protective material to the surface of a photoreceptor, a pressure application member contacting the protective material block to the protective material application member upon application of pressure and a protection layer forming member forming a thin layer of the protective material to form a protection layer, and other means when necessary. When the protection layer former has the protection layer forming member, the protection layer forming member may combine a cleaning member. However, in order to steadily form a protection layer, it is preferable that a survival which is mostly a toner is previously removed by the cleaning member such that the survival does not mix in the protection layer.

Figure 2:
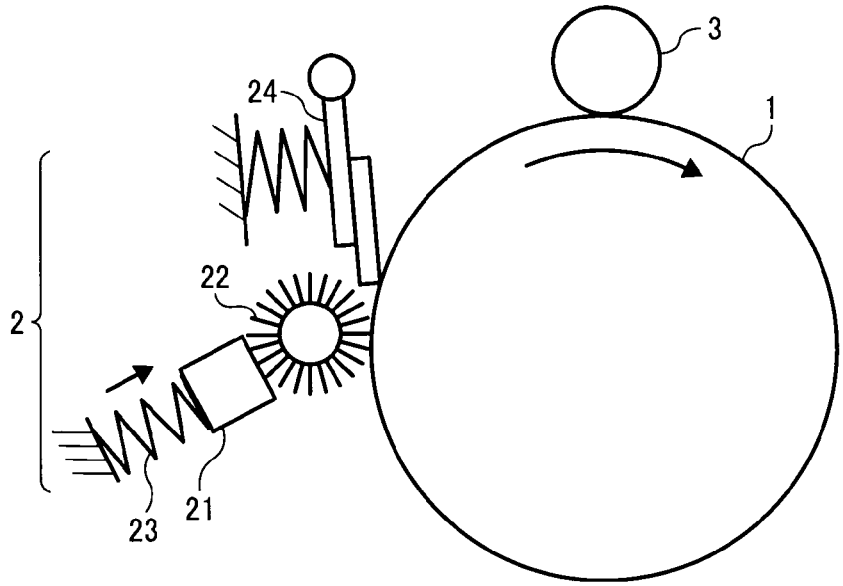
FIG. 2 is a schematic view illustrating an embodiment of the protection layer former of the present invention.

FIG. 2 is a schematic view illustrating an embodiment of the protection layer former of the present invention. A protection former 2 located facing a drum-shaped photoreceptor 1 mainly includes a protective material bar 21, a protective material application member 22, a pressure application member 23 and a protection layer forming member 24, etc.

The protective material block 21 of the present invention contacts the brush-shaped protective material application member 22 with a pressure from the pressure application member 23. The protective material application member 22 rotates at a linear speed different from that of the photoreceptor 1 to scrape the photoreceptor to provide the protective material held on the surface of the protective material application member to the surface of the photoreceptor.

So as to make the protection layer formed of the protective material more uniform, the protective material applied to the surface of the photoreceptor is formed to a thin layer thereon by the protection layer forming member having a blade-shaped member.

A charging roller 3 applied with a DC voltage or a DC voltage overlapped with an AC voltage from a high-voltage electrical source (not shown) contacts or stands close to the photoreceptor the protection layer formed on discharges in a microscopic space therebetween to charge the photoreceptor. Then, the protection layer is partially decomposed or oxidized, and a discharge product adheres to the surface of the protection layer, resulting in deteriorated products.

Figure 3:
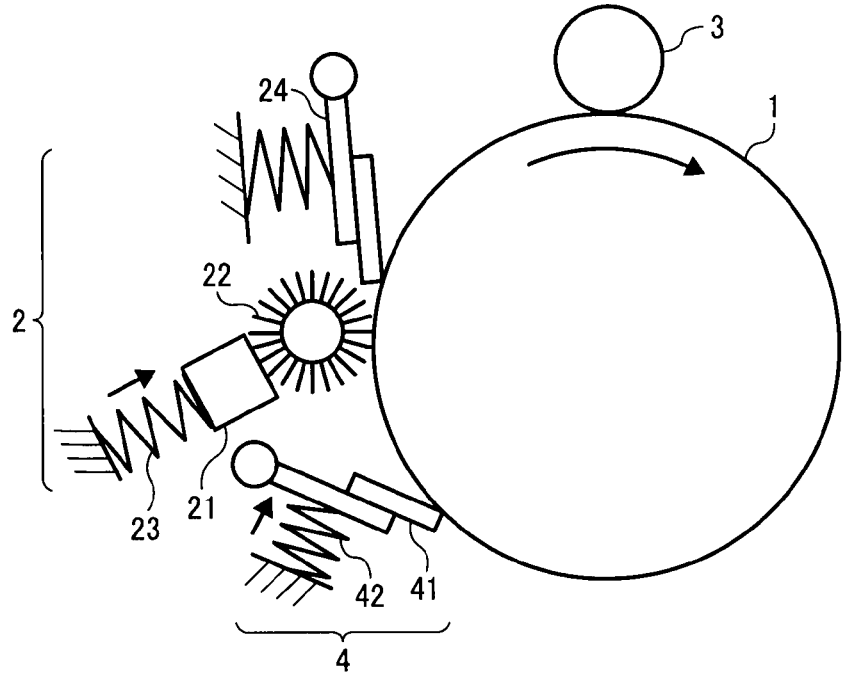
FIG. 3 is a schematic view illustrating another embodiment of the protection layer former of the present invention.

The deteriorated protective material is removed by a typical cleaner with a toner remaining on the photoreceptor. The cleaner may be combined with the protection layer forming member. However, the removing function and protection layer forming function are preferably separated as shown in FIG. 3, in which a cleaner 4 including a cleaning member 41 and a cleaning pressurizer 42 is located upstream of the protective material application member.

Materials for the blade of the protection layer forming member are not particularly limited, and include known elastic bodies for cleaning blades, such as a urethane rubber, a hydrin rubber, a silicone rubber and a fluorine-containing rubber. These can be used alone in combination. Contacts points of these rubber blades to the photoreceptor 1 may be coated or impregnated with a low-resistivity material. In addition, an organic or an inorganic filler may be dispersed in the elastic bodies to control the hardness thereof.

The protective material forming member may be located in the counter direction or trailing direction of the rotation direction of a photoreceptor. However, the counter direction expands the protective material more on the photoreceptor. Therefore, the protective material forming member is preferably in the counter direction of the rotation direction of a photoreceptor because of expanding the protective material quickly on the photoreceptor even when having a higher linear speed.

The cleaning blade is fixed onto a blade holder by way of an adhesive or fusion bond such that the edges thereof are pressed to the surface of the photoreceptor. The thickness of the blade is not unambiguously defined because of the pressure, however, preferably from 0.5 to 5 mm, and more preferably from 1 to 3 mm.

In addition, the free length of the blade projected from the holder and capable of having flexibility is not unambiguously defined because of the pressure, however, preferably from 1 to 15 mm, and more preferably from 2 to 10 mm.

The blade for forming a protection layer may be formed by forming a resin, a rubber or an elastomer layer on the surface of an elastic metal blade such as a leaf by coating or dipping methods with a coupling agent and a primer when necessary, and may be thermally-hardened and further subjected to surface grinding when necessary.

Materials forming a surface layer of the elastic metal blade include fluorine-containing resins such as PFA, PTFE, FEP and PVdF; fluorine-containing rubbers; and silicone elastomers such as a methylphenyl silicone elastomer. These are used with a filler, but are not limited thereto.

The elastic metal blade preferably has a thickness of from 0.05 to 3 mm, and more preferably from 0.1 to 1 mm. The elastic metal blade may be subjected to bending work in the direction parallel with the spindle after installed to prevent a twist of the blade.

The protection layer forming member preferably presses the photoreceptor at from 5 to 80 gf/cm, and more preferably from 10 to 60 gf/cm to expand a protective material on the surface of a photoreceptor to be a protection layer or film thereon.

The brush is preferably used for the protective material application member, and the brush preferably has a flexible fiber. Specific examples of materials for the flexible brush fiber include known materials such as polyolefin resins, e.g., polyethylene and polypropylene; polyvinyl and polyvinylidene resins, e.g., polystyrene, acrylic resins, polyacrylonitrile, polyvinylacetate, polyvinylalcohol, polyvinylbutyral, polyvinylchloride, polyvinylcarbazole, polyvinylether and polyvinylketone; vinylchloride-vinylacetate copolymers; styrene-acrylic acid copolymers; styrene-butadiene resins; fluorine-containing resins, e.g., polytetrafluoroethylene, polyvinylfluoride, polyvinylidenefluoride and polychlorotrif luoroethylene; polyester; nylon; acrylic resins; rayon; polyurethane; polycarbonate; phenol resins; amino resins, e.g., urea-formaldehyde resins, melamine resins, benzoguanamine resins, urea resins and polyamide resins. These can be used alone or in combination.

In addition, diene rubbers, styrene-butadiene rubbers (SBR), ethylene propylene rubbers, isoprene rubbers, nitrile rubbers, urethane rubbers, silicone rubbers, hydrin rubbers, norbornene rubbers, etc. may be combined to control the flexibility.

The protective material application member includes a fixed or a rotatable roll-shaped holder. The rolled-shaped application member includes a roll brush formed of a metallic shaft on which a brush fiber pile tape is spirally wound. The brush fiber preferably has a diameter of from 10 to 500 μm, a length of from 1 to 15 mm, and a fiber density of from 10,000 to 300,000/square inch, i.e., from $1.5\times10^7$ to $4.5\times10^8/m^2$.

The brush fiber density is preferably as high as possible in terms of uniform and stable application of the protective material. One fiber is preferably formed of from a few to a few hundred fine fibers. For example, as 333 decitex=6.7 decitex× 50 filaments (300 denier=5 denier×50 filaments), 50 fine fibers of 6.7 decitex (6 denier) can be implanted as one fiber.

The brush may have a coated layer to stabilize the surface shape and environmental resistance. The coated layer preferably includes a deformable component in compliance with flexibility of the brush fiber. Specific examples thereof are not limited if they are capable of maintaining flexibility, and include polyolefin resins such as polyethylene, polypropylene, polyethylene chloride; chlorosulfonated polyethylene; polyvinyl and polyvinylidene resins such as polystyrene, acrylic resins, e.g., polymethylmethacrylate, polyacrylonitrile, polyvinylacetate, polyvinylalcohol, polyvinylbutyral, polyvinylchloride, polyvinylcarbazole, polyvinylether and polyvinylketone; vinylchloride-vinylacetate copolymers; silicone resins formed of organosiloxane bondings or their modified resins, e.g., modified alkyd resins, polyester resins, epoxy resins and polyurethane; fluorine-containing resins such as perfluoroalkylether, polyfluorovinyl, polyfluorovinylidene and polychlorotrifluoroethylene; polyamide; polyester; polyurethane; polycarbonate; amino resins such as urea-formaldehyde resins; epoxy resins; and their complex resins.

In the image forming apparatus of the present invention, a protective material can be uniformly coated on a photoreceptor whatever the linear speed thereof is. Therefore, high-quality images can be produced for long periods, and particularly when the linear speed is 180 mm or more, and further 250 mm/sec or more, high-quality images cannot be produced for long periods without the protective material of the present invention.

The image forming method of the present invention includes at least an electrostatic latent image forming process, a developing process, a transferring process and a fixing process, and preferably a cleaning process. Further, the image forming method optionally includes other processes such as a discharging process, a toner recycling process and a controlling process.

The image forming apparatus of the present invention includes at least a photoreceptor, an electrostatic latent image former, an image developer, a transferer and a fixer; and optionally includes other means such as a discharger, a cleaner, a recycler and a controller.

The image forming method of the present invention can be performed by the image forming apparatus of the present invention, the electrostatic latent image forming process, the developing process, the transferring process, the protection layer forming process, the fixing process are performed with the electrostatic latent image former, the image developer, the transferer, the protective material applicator and the fixer, respectively. The other optional processes can be performed with the optional means mentioned above.

The electrostatic latent image forming process is a process of forming an electrostatic latent image on a photoreceptor.

The material, shape, structure, size, etc. of the photoreceptor are not particularly limited, and can be selected from known electrostatic latent image bearers. However, the electrostatic latent image bearer preferably has the shape of a drum, and the material is preferably an inorganic material such as amorphous silicon and serene, and an organic material such as polysilane and phthalopolymethine.

The photoreceptor for use in the image forming apparatus of the present invention includes an electroconductive substrate and at lest a photosensitive layer and other optional layers thereon.

The photosensitive layer includes a single layer mixing a charge generation material (CGM) and a charge transport material (CTM); ordinarily-layered layer including a charge generation layer (CGL) and a charge transport layer (CTL) thereon; and a reverse layer including a charge transport layer (CTL) and a charge generation layer (CGL) thereon. The photoreceptor can have an outermost surface layer on the photosensitive layer to improve the mechanical strength, abrasion resistance, gas resistance and cleanability thereof. The photoreceptor may have an undercoat layer between the photosensitive layer and the electroconductive substrate. Each o the layers can include a plasticizer, an antioxidant, a leveling agent, etc. when necessary.

Suitable materials for use as the electroconductive substrate include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum, etc., or a metal oxide such as tin oxides, indium oxides, etc., is deposited or sputtered. In addition, a plate of a metal such as aluminum, aluminum alloys, nickel and stainless steel and a metal cylinder, which is prepared by tubing a metal such as the metals mentioned above by a method such as impact ironing or direct ironing, and then treating the surface of the tube by cutting, super finishing, polishing, etc. can also be used as the substrate.

Figure 8:
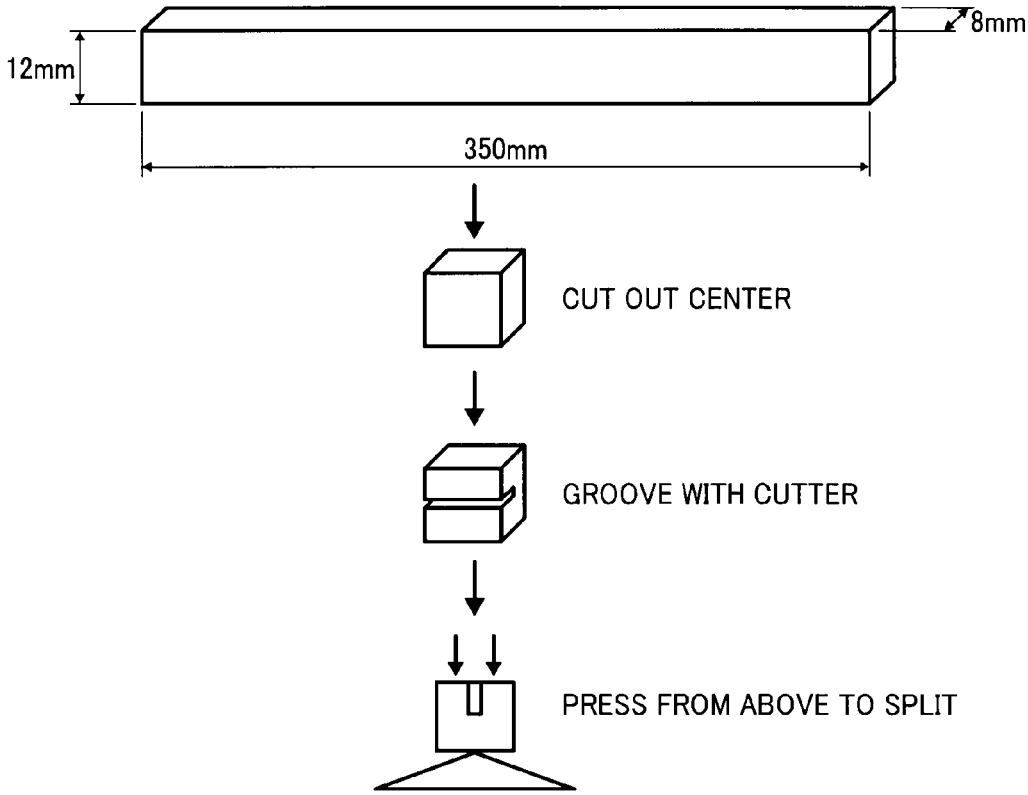
FIG. 8 is a schematic view for explaining how to split a protective material block.

The drum-shaped substrate preferably has a diameter of from 20 to 150 mm, more preferably from 24 to 100 mm, and furthermore preferably from 28 to 70 mm. When less than 20 mm, a charger, an irradiator, an image developer, a transferer and a cleaner are physically difficult to locate around the drum. When greater than 150 mm, the image forming apparatus becomes large. Particularly for the tandem image forming apparatus having plural photoreceptors as shown in FIG. 8, the drum preferably has a diameter not greater than 70 mm, and more preferably not greater than 60 mm. Further, endless belts of a metal such as nickel and stainless steel, which have been disclosed in Japanese published unexamined application No. 52-36016, can also be used as the electroconductive substrate.

The undercoat layer includes (1) a resin, (2) a mixture of a white pigment and a resin or (3) an oxidized metallic film which is a chemically or electrically oxidized surface of the electroconductive substrate, among which the mixture of a white pigment and a resin is preferably used. Specific examples of the white pigment include metal oxides such as a titanium oxide, a zirconium oxide and a zinc oxide, among which the titanium oxide preventing a charge from being injected to the undercoat layer from the electroconductive substrate is preferably included therein.

Specific examples of the resin for use therein include thermoplastic resins such as polyamide, polyvinylalcohol, casein and methylcellulose; and thermosetting resins such as an acrylic resin, a phenol resin, a melamine resin, an alkyd resin, an unsaturated polyester resin and an epoxy resin. These can be used alone or in combination.

The undercoat layer preferably has a thickness of from 1 to 10 μm, and more preferably from 1 to 5 μm.

Specific examples of the charge generation material include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine dyes, styryl dyes, pyrylium dyes, quinacridone dyes, indigo dyes, perylene dyes, polycyclic quinone pigments, bisbenzimidazole pigments, indanthrone pigments, Squarilium pigments and phthalocyanine pigments; and inorganic materials such as serene, serene-arsenic, serene-tellurium, cadmium sulfide, zinc oxide, titanium oxide and amorphous silicone. These charge generation materials can be used alone or in combination.

Specific examples of the charge transport material include anthracene derivatives, pyrene derivatives, carbazole derivatives, tetrazole derivatives, metallocene derivatives, phenothiazine derivatives, pyrazoline derivatives, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, triphenylmethane derivatives, etc. These can be used alone or in combination.

Specific examples of binder resins for use in forming the photosensitive layer including the charge generation layer and the charge transport layer include, but are not limited to, insulative thermoplastic resins such as polyvinylchloride, polyvinylidenechloride, vinylchloride-vinylacetate copolymers, vinylchloride-vinylacetate-maleic anhydride copolymers, ethylene-vinylacetate copolymers, polyvinylbutyral, polyvinylacetal, polyester, phenoxy resins, (metha)acrylic resins, polystyrene, polycarbonate, polyarylate, polysulfone, polyethersulfone and ABS resins; thermosetting resins such as phenol resins, epoxy resins, urethane resins, melamine resins, isocyanate resins, alkyd resins, silicone resins and thermosetting acrylic resins; and photoconductive resins such as polyvinyl carbazole, polyvinyl anthracene and polyvinyl pyrene. These can be used alone or in combination.

Specific examples of the antioxidant include monophenolic compounds such as 2,6-di-t-butyl-p-cresol, butylated hydroxyanisole, 2,6-di-t-butyl-4-ethylphenol, n-octadecyl-3-(4'-hydroxy-3',5'-di-t-butylphenol) and 3-t-butyl-4-hydroxyanisole; bisphenolic compounds such as 2,2'-methylene-bis-(4-methyl-6-t-butylphenol), 2,2'-methylene-bis-(4-ethyl-6-t-butylphenol), 4,4'-thiobis-(3-methyl-6-t-butylphenol) and 4,4'-butylidenebis-(3-methyl-6-t-butylphenol); phenolic polymer compounds such as 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester and tocophenol compounds; paraphenylenediamine compounds such as N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine and N,N'-dimethyl-N,N'-di-t-butyl-p-phenylenediamine; hydroquinone compounds such as 2,5-di-t-octylhydroquinone, 2,6-didodecylhydroquinone, 2-dodecylhydroquinone, 2-dodecyl-5-chlorohydroquinone, 2-t-octyl-5-methylhydroquinone and 2-(2-octadecenyl)-5-methylhydroquinone; organic sulfur-containing compounds such as dilauryl-3,3'-thiodipropionate, distearyl-3,3'-thiodipropionate and ditetradecyl-3,3'-thiodipropionate; and organic phosphorus-containing compounds such as triphenylphosphine, tri(nonylphenyl)phosphine, tri(dinonylphenyl)phosphine, tricresylphosphine and tri(2,4-dibutylphenoxy)phosphine.

These compounds are known as antioxidants for rubbers, plastics and fats, and marketed products are available.

A layer preferably includes the antioxidant in an amount of from 0.01 to 10% by weight.

Specific examples of the plasticizer include plasticizers for typical resins, such as dibutylphthalate and dioctylphthalate, and each layer preferably includes the plasticizer in an amount of from 0 to 30 parts by weight per 100 parts by weight of the binder resin.

Specific examples of the leveling agent include silicone oil such as dimethyl silicone oil and methylphenyl silicone oil; and polymers or oligomers having a perfluoroalkyl group in the side chain, and each layer preferably includes the leveling agent in an amount of from 0 to 1 part by weight per 100 parts by weight of the binder resin.

The outermost surface layer is formed on the photosensitive layer of a photoreceptor to improve the mechanical strength, abrasion resistance, gas resistance and cleanability thereof. The outermost surface layer is preferably formed of a polymer having a mechanical strength higher than that of the photosensitive layer and a filler dispersed in the polymer. Either thermoplastic resins or thermosetting resins may be used in the outermost surface layer. The thermosetting resins are preferably used because of having high mechanical strength and preventing abrasion due to friction with the cleaning blade. The outermost surface layer need not have charge transportability when thin. However, when thick without charge transportability, the photoreceptor deteriorates in sensitivity, and increases in potential after irradiated and residual potential. Therefore, the surface layer preferably includes a charge transport material or a charge transportable polymer.

Since the photosensitive layer and the outermost surface layer largely differ in mechanical strength, when the outermost surface layer is abraded due to friction with the cleaning blade and disappears, the photosensitive layer is quickly abraded. Therefore, the outermost surface layer needs to have a sufficient thickness, preferably of from 0.1 to 12 μm, more preferably from 1 to 10 μm, and furthermore preferably from 2 to 8 μm. When less than 0.1 μm, the surface layer is partially abraded with the friction with the cleaning blade and disappears, the photosensitive layer is abraded from the part disappeared. When thicker than 12 μm, the photoreceptor deteriorates in sensitivity, and increases in potential after irradiated and residual potential. Particularly, a charge transportable polymer is used, the cost thereof increases.

Resins for use in the outermost surface layer preferably has transparency to image writing light, good insulation, mechanical strength and adhesiveness. Specific examples thereof include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, etc. These polymers may be thermoplastic resins, and preferably crosslinked with a crosslnker having a multifunctional acryloyl groupm, a carboxyl group, a hydroxyl group, an amino group, etc. to form thermosetting resins to increase mechanical strength of the outermost surface layer and largely reduce the abrasion due to friction with the cleaning blade.

The outermost surface layer preferably has charge transportability, and for which a polymer and a charge transport material are used together in the outermost surface layer or charge transportable polymer is used therein. The latter is preferably used to prepare a high-sensitive photoreceptor with less increase in potential after irradiated and residual potential.

The charge transportable polymer includes groups having charge transportability in its polymeric molecule and the following formula (i):

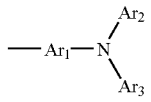

(i)

wherein $Ar_1$ represents an arylene group optionally having a substituent.

The group having charge transportability is preferably added to a side chain of a polymer having high mechanical strength such as a polycarbonate resin and an acrylic resin, and particularly the acrylic resin, the monomer of which is easily prepared, having good coatability and hardenability is more preferably used.

The acrylic resin having charge transportability polymerized with an unsaturated carboxylic acid having a group having the formula (i) can form a surface layer having high mechanical strength, good transparency and high charge transportability. In addition, the acrylic resin polymerized with an unsaturated carboxylic acid having a monofunctional group having the formula (i) mixed with a multifunctional unsaturated carboxylic acid, preferably a tri- or more unsaturated carboxylic acid forms a crosslinked structure and becomes a thermosetting polymer, and the resultant surface layer has very high mechanical strength. A group having the formula (i) may be added to the multifunctional unsaturated carboxylic acid, however, which increases the cost of preparing a monomer and a light hardening multifunctional monomer is preferably used instead of the group having the formula (i).

Specific examples of the monofunctional unsaturated carboxylic acid having a group having the formula (i) include compounds having the following formulae (ii) and (iii):

(ii)

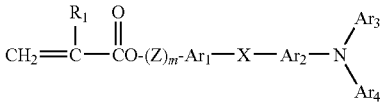

(iii)

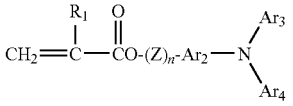

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$ wherein $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ independently represent a substituted or an unsubstituted arylene group; $Ar_3$ and $Ar_4$ independently represent a substituted or an unsubstituted aryl group; X represents a single bond, a substituted or an unsubstituted alkylene group, a substituted or an unsubstituted cycloalkylene group, a substituted or an unsubstituted alkyleneether group, an oxygen atom, a sulfur atom and vinylene group; Z represents a substituted or an unsubstituted alkylene group, a substituted or an unsubstituted alkyleneether group and alkyleneoxycarbonyl group; and m and n represent 0 and an integer of from 1 to 3.

In the formulae (ii) and (iii), among substituted groups of $R_1$, the alkyl groups include methyl groups, ethyl groups, propyl groups, butyl groups, etc.; the aryl groups include phenyl groups, naphtyl groups, etc.; aralkyl groups include benzyl groups, phenethyl groups, naphthylmethyl groups, etc.; and alkoxy groups include methoxy groups, ethoxy groups, propoxy groups, etc. These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups. The substituted group of $R_1$, is preferably a hydrogen atom and a methyl group.

$Ar_3$ and $Ar_4$ independently represent a substituted or an unsubstituted aryl group, and specific examples thereof include condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an As-indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a crycenyl group and a naphthacenyl group.

Specific examples of the non-condensed cyclic hydrocarbon groups and heterocyclic groups include monovalent groups of monocyclic hydrocarbon compounds such as benzene, diphenylether, polyethylenediphenylether, diphenylthioether, and diphenylsulfone; monovalent groups of non-condnesed hydrocarbon compounds such as biphenyl, polyphenyl, diphenylalkane, diphenylalkene, diphenylalkine, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene and oxadiazole.

The outermost surface layer preferably includes the multifunctional unsaturated carboxylic acid in an amount of from 5 to 75% by weight, more preferably from 10 to 70% by weight, and furthermore preferably from 20 to 60% by weight. When les than 5% by weight, the outermost surface layer has insufficient mechanical strength. When greater than 75% by weight, the outermost surface layer is likely to have a crack when receiving a strong force and the sensitivity of the resultant photoreceptor occasionally deteriorates.

When the acrylic resin is used in the outermost surface layer, after the unsaturated carboxylic acid is coated on a photoreceptor, an electron beam or an active beam such as ultraviolet is irradiated thereto to perform a radical polymerization thereon and form a surface layer. When the radical polymerization is performed with the active beam, a photopolymerization initiator is dissolved in the unsaturated carboxylic acid. Materials used in light hardening coating are typically used as the photopolymerization initiator.

Particulate metals or metal oxides can be dispersed in the outermost surface layer to increase the mechanical strength thereof. Specific examples of the metal oxides include alumina, titanium oxide, tin oxide, kalium titanate, $TiO_2$, TiN, zinc oxide, indium oxide and antimony oxide. Besides, fluorine-containing resins such as polytetrafluoroethylene, silicone resins, materials including these resins and inorganic materials dispersed there in, etc. can be included in the outermost surface layer to improve abrasion resistance thereof.

The electrostatic latent image is formed by uniformly charging the surface of the electrostatic latent image bearer and irradiating imagewise light onto the surface thereof with the electrostatic latent image former. The electrostatic latent image former includes at least a charger uniformly charging the surface of the electrostatic latent image bearer and an irradiator irradiating imagewise light onto the surface thereof.

The surface of the electrostatic latent image bearer is charged with the charger upon application of voltage.

The charger is not particularly limited, and can be selected in accordance with the purpose, such as an electroconductive or semiconductive rollers, bushes, films, known contact chargers with a rubber blade, and non-contact chargers using a corona discharge such as corotron and scorotron.

The charger preferably charges a photoreceptor with a DC voltage overlapped with an AC voltage.

The surface of the electrostatic latent image bearer is irradiated with the imagewise light by the irradiator.

The irradiator is not particularly limited, and can be selected in accordance with the purpose, provided that the irradiator can irradiate the surface of the electrostatic latent image bearer with the imagewise light, such as reprographic optical irradiators, rod lens array irradiators, laser optical irradiators and a liquid crystal shutter optical irradiators.

In the present invention, a backside irradiation method irradiating the surface of the electrostatic latent image bearer through the backside thereof may be used.

The developing process is a process of forming a visual image by developing the electrostatic latent image with a toner or a developer.

The visual image is formed by the image developer developing the electrostatic latent image with the toner or developer.

The image developer is not particularly limited, and can be selected from known image developers, provided that the image developer can develop with the toner or developer. For example, an image developer containing the toner or developer and being capable of imparting the toner or developer to the electrostatic latent image in contact or not in contact therewith is preferably used.

A toner for use in the image forming apparatus of the present invention preferably has an average circularity of from 0.93 to 1.00. The circularity SR is defined as follows:

SR=a peripheral length of a circle having an area equivalent to that of a projected area of a particle/a peripheral length of a projected image of the particle.

The closer a toner to a true sphere, the closer the SR to 1.00. The more complicated the surface of the circle, the less the SR. When a toner has an average circularity of from 0.93 to 1.00, the toner has smooth surface and has good transferability because of having a small contact area with another toner or a photoreceptor. Since the toner has no corner, a developer including the toner is stably stirred in the image developer to prevent production of abnormal images, a pressure is evenly applied to the toner when transferred onto the transfer medium to prevent production of hollow images, and the toner does not scratch or abrades the surface of a photoreceptor.

The circularity is measured with flow-type particle image analyzer FPIA-1000 from SYSMEX CORP. A measurement liquid was prepared by the following method and set therein:

0.1 to 0.5 ml of a surfactant (alkylbenzenesulfonate salt) was added to 100 to 150 ml of water impurities were ready removed from as a dispersant to prepare an aqueous solution;

adding 0.1 to 0.5 g of a measurement sample thereto; and dispersing the aqueous solution with an ultrasonic disperser for 1 to 3 min to prepare a measurement liquid including 3,000 to 10,000 pieces/μl.

In addition to the circularity, the toner preferably has a weight-average particle diameter D4 of from 3 to 10 μm. Having sufficiently small particle diameter, the toner has good dot reproducibility of microscopic latent dots. When less than 3 μm, the transferability and cleanability of the toner deteriorates. When greater than 10 μm, it is difficult to prevent letters and lines from scattering.

Further, the toner preferably has a ratio (D4/D1) of the weight-average particle diameter D4 to a number-average particle diameter D1 of from 1.00 to 1.40. The closer to 1.00, the sharper the particle diameter distribution the toner has. Therefore, the toner having the ratio of from 1.00 to 1.40 produces stable-quality images. The toner has a sharp friction charged quantity distribution as well to prevent production of foggy images. Further, a toner having a uniform particle diameter has good dot reproducibility because the toner is precisely and orderly developed on a latent dot.

The particle diameter distribution of a toner can be measured by a Coulter counter TA-II or Coulter Multisizer II from Coulter Electronics, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

Such an almost spherical toner is preferably prepared by crosslinking and/or elongating a toner composition including a polyester prepolymer having a functional group including a nitrogen atom, polyester, a colorant and a release agent in an aqueous medium under the presence of a particulate resin. The thus prepared toner has a hardened surface to decrease hot offset contaminating the fixer.

Prepolymers formed of modified polyester resins used for preparing a toner include polyester prepolymers having an isocyanate group (A), and compounds elongatable or crosslinkable with the prepolymer include amines (B).

The polyester prepolymer having an isocyanate group (A) is formed from a reaction between polyester having an active hydrogen atom formed by polycondensation between a polyol (1) and a polycarboxylic acid (2), and polyisocyanate (3). Specific examples of the groups including the active hydrogen include a hydroxyl group (such as an alcoholic hydroxyl group and a phenolic hydroxyl group), an amino group, a carboxyl group, a mercapto group, etc. In particular, the alcoholic hydroxyl group is preferably used.

As the polyol (1), diol (1-1) and polyols having 3 valences or more (1-2) can be used, and (1-1) alone or a mixture of (1-1) and a small amount of (1-2) are preferably used.

Specific examples of diol (1-1) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, an alkylene glycol having 2 to 12 carbon atoms and adducts of bisphenol with an alkylene oxide are preferably used, and a mixture thereof is more preferably used.

Specific examples of the polyol having 3 valences or more (1-2) include multivalent aliphatic alcohols having 3 to 8 or more valences such as glycerin, trimethylolethane, trimethylolpropane, pentaerythritol and sorbitol; phenols having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acids (2-1) and polycarboxylic acids having 3 or more valences (2-2) can be used. (2-1) alone, or a mixture of (2-1) and a small amount of (2-2) are preferably used.

Specific examples of the dicarboxylic acid (2-1) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid. In particular, an alkenylene dicarboxylic acid having 4 to 20 carbon atoms and an aromatic dicarboxylic acid having 8 to 20 carbon atoms are preferably used.

Specific examples of the polycarboxylic acid having 3 or more valences (2-2) include aromatic polycarboxylic acids having 9 to 20 carbon atoms such as trimellitic acid and pyromellitic acid. The polycarboxylic acid (2) can be formed from a reaction between one or more of the polyols (1) and an anhydride or lower alkyl ester of one or more of the above-mentioned acids. Suitable preferred lower alkyl esters include, but are not limited to, methyl esters, ethyl esters and isopropyl esters.

The polyol (1) and polycarboxylic acid (2) are mixed such that the equivalent ratio ( [OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (3) include aliphatic polyisocyanates such as tetramethylenediisocyanate, hexamethylenediisocyanate and 2,6-diisocyanatemethylcaproate; alicyclic polyisocyanates such as isophoronediisocyanate and cyclohexylmethanediisocyanate; aromatic diisocyanates such as tolylenedisocyanate and diphenylmethanediisocyanate; aromatic aliphatic diisocyanates such as α,α,α', α'-tetramethylxylylenediisocyanate; isocyanurates; the above-mentioned polyisocyanates blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, a urea content in ester of the modified polyester decreases and hot offset resistance of the resultant toner deteriorates.

A content of the constitutional component of a polyisocyanate in the polyester prepolymer (A) having a polyisocyanate group at its end is from 0.5 to 40% by weight, preferably from 1 to 30% by weight and more preferably from 2 to 20% by weight. When the content is less than 0.5% by weight, the hot offset resistance of the resultant toner deteriorates, and in addition, the heat resistance and low-temperature fixability of the toner also deteriorate. In contrast, when the content is greater than 40% by weight, the low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of isocyanate groups is less than 1 per molecule, the molecular weight of the urea-modified polyester decreases and hot offset resistance of the resultant toner deteriorates. Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked. Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophoronediamine; aliphatic diamines such as ethylene diamine, tetramethylene diamine and hexamethylene diamine, etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine (B1) is mixed with a small amount of a polyamine (B2) are preferably used.

The molecular weight of the urea-modified polyesters can optionally be controlled using an elongation anticatalyst, if desired. Specific examples of the elongation anticatalyst include monoamines such as diethyl amine, dibutyl amine, butyl amine and lauryl amine, and blocked amines, i.e., ketimine compounds prepared by blocking the monoamines mentioned above.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, the molecular weight of the urea-modified polyester (i) decreases, resulting in deterioration of hot offset resistance of the resultant toner.

The urea-modified polyester (i) may include a urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The urea-modified polyester (i) can be prepared by a method such as a one-shot method or a prepolymer method. The weight-average molecular weight of the urea-modified polyester (i) is not less than 10,000, preferably from 20,000 to 10,000,000 and more preferably from 30,000 to 1,000,000. When the weight-average molecular weight is less than 10,000, hot offset resistance of the resultant toner deteriorates.

The number-average molecular weight of the urea-modified polyester is not particularly limited when the after-mentioned unmodified polyester resin (ii) is used in combination. Namely, the weight-average molecular weight of the urea-modified polyester (i) has priority over the number-average molecular weight thereof when combined with an unmodified polyester (ii) mentioned later. However, when the urea-modified polyester (i) is used alone, the number-average molecular weight is not greater than 20,000, preferably from 1,000 to 10,000 and more preferably from 2,000 to 8,000. When the number-average molecular weight is greater than 20,000, the low temperature fixability of the resultant toner deteriorates, and in addition the glossiness of full color images deteriorates.

In the present invention, an unmodified polyester resin (ii) can be used in combination with the urea-modified polyester resin (i) as a toner binder resin. It is more preferable to use the unmodified polyester resin (ii) in combination with the modified polyester resin than to use the urea-modified polyester resin alone because low-temperature fixability and glossiness of full color images of the resultant toner improve. Specific examples of the unmodified polyester resin (ii) include polycondensed products between the polyol (1) and polycarboxylic acid (2) similarly to the urea-modified polyester resin (i), and the components preferably used are the same as those thereof. It is preferable that the urea-modified polyester resin (i) and unmodified polyester resin (ii) are partially soluble with each other in terms of the low-temperature fixability and hot offset resistance of the resultant toner.

Therefore, the urea-modified polyester resin (i) and unmodified polyester resin (ii) preferably have similar compositions. When the unmodified polyester resin (ii) is used in combination, a weight ratio ((i)/(ii)) between the urea-modified polyester resin (i) and unmodified polyester resin (ii) is from 5/95 to 80/20, preferably from 5/95 to 30/70, more preferably from 5/95 to 25/75, and most preferably from 7/93 to 20/80. When the urea-modified polyester resin (i) has a weight ratio less than 5%, the resultant toner has poor hot offset resistance, and has difficulty in having a thermostable preservability and low-temperature fixability.

The unmodified polyester resin (ii) preferably has a peak molecular weight of from 1,000 to 20,000, preferably from 1,500 to 10,000, and more preferably from 2,000 to 8,000. When less than 1,000, the thermostable preservability of the resultant toner deteriorates. When greater than 10,000, the low-temperature fixability thereof deteriorates. The unmodified polyester resin (ii) preferably has a hydroxyl value not less than 5 mg KOH/g, more preferably of from 10 to 120 mg KOH/g, and most preferably from 20 to 80 mg KOH/g. When less than 5 mg KOH/g, the resultant toner has difficulty in having thermostable preservability and low-temperature fixability. The unmodified polyester resin (ii) has an acid value of from 1 to 30 mg KOH/g, and more preferably from 5 to 20 mg KOH/g such that the resultant toner tends to be negatively charged.

The binder resin preferably has a glass transition temperature (Tg) of from 50 to 70° C., and more preferably from 55 to 65° C. When less than 50° C., a thermostable preservability of the resultant toner deteriorates. When greater than 70° C., a low-temperature fixability thereof is insufficient. A dry toner including the unmodified polyester resin (ii) and the urea-modified polyester resin (i) has a better thermostable preservability than known polyester toners even though the glass transition temperature is low.

The binder resin preferably has a temperature at which a storage modulus of the toner binder resin is 10,000 dyne/cm$^2$ at a measuring frequency of 20 Hz (TG'), of not less than 100° C., and more preferably of from 110 to 200° C. When less than 100° C., the hot offset resistance of the resultant toner deteriorates.

The toner binder resin preferably has a temperature at which the viscosity is 1,000 poise (Tη), of not greater than 180° C., and more preferably of from 90 to 160° C. When greater than 180° C., the low-temperature fixability of the resultant toner deteriorates. Namely, TG' is preferably higher than Tη in terms of the low-temperature fixability and hot offset resistance of the resultant toner. In other words, the difference between TG' and Tη (TG'−Tη) is preferably not less than 0° C., more preferably not less than 10° C., and furthermore preferably not less than 20° C. The maximum of the difference is not particularly limited. In terms of the thermostable preservability and low-temperature fixability of the resultant toner, the difference between TG' and Tη (TG'−Tη) is preferably from 0 to 100° C., more preferably from 10 to 90° C., and most preferably from 20 to 80° C.

The binder resin can be prepared, for example, by the following method.

The polyol (1) and polycarboxylic acid (2) are heated at a temperature of from 150 to 280° C. in the presence of a known catalyst such as tetrabutoxy titanate and dibutyltinoxide. Then, water generated is removed, under a reduced pressure if desired, to prepare a polyester resin having a hydroxyl group. Then the polyester resin is reacted with the polyisocyanate (3) at a temperature of from 40 to 140° C. to prepare a prepolymer having an isocyanate group (A). Further, the prepolymer (A) is reacted with an amine (B) at a temperature of from 0 to 140° C. to prepare a urea-modified polyester. When (3), and (A) and (B) are reacted, a solvent can be used if desired.

Suitable solvents include solvents which do not react with polyisocyanate (3). Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran.

When the unmodified polyester (ii) is used in combination with the urea-modified polyester (i), a method similar to a method for preparing a polyester resin having a hydroxyl group is used to prepare the unmodified polyester (ii), and which dissolved and mixed in a solution after a reaction of the urea-modified polyester (i) is completed.

The toner for use in the present invention can be prepared by, but is not limited to, the following method.

The toner may be prepared by reacting a dispersion including the prepolymer having an isocyanate group (A) with the amine (B) in an aqueous medium, or may use a previously-prepared unrea-modofied polyester (i). As a method of stably preparing a dispersion formed of the prepolymer (A) and the unmodified polyester resin (ii) in an aqueous medium, a method of including a toner constituent formed of the prepolymer (A) and the unmodified polyester resin (ii) into an aqueous medium and dispersing them upon application of shear stress is preferably used.

The prepolymer (A), the unmodified polyester resin (ii) and other toner constituents (hereinafter referred to as toner materials) such as colorants, master batch pigments, release agents and charge controlling agents, etc. may be added into an aqueous medium at the same time when the dispersion is prepared. However, it is preferable that the toner materials are previously mixed, and then are added to the aqueous medium. In addition, other toner materials such as colorants, release agents, charge controlling agents, etc., are not necessarily added to the aqueous dispersion before particles are formed, and may be added thereto after particles are prepared in the aqueous medium. For example, after forming particles without a colorant, a colorant can also be added thereto by known dying methods.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

A content of the aqueous medium to 100 parts by weight of the toner constituent including the prepolymer (A) and the unmodified polyester resin (ii) or is typically from 50 to 2,000 parts by weight, and preferably from 100 to 1,000 parts by weight. When the content is less than 50 parts by weight, the dispersion of the toner constituent in the aqueous medium is not satisfactory, and thereby the resultant mother toner particles do not have a desired particle diameter. In contrast, when the content is greater than 2,000, the production cost increases.

A dispersant can preferably be used to prepare a stably dispersed dispersion including particles having a sharp particle diameter distribution.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 min. The temperature in the dispersion process is typically from 0 to 150° C. (under pressure), and preferably from 40 to 98° C. When the temperature is relatively high, the modified polyester (i) or prepolymer (A) can easily be dispersed because the dispersion formed thereof has a low viscosity.

The urea-modified polyester (i) may be prepared from the prepolymer (A) by adding amines (B) in the aqueous medium before or after the toner constituent is dispersed therein. The urea-modified polyester is preferentially formed on the surface of the resultant toner, and which can have a gradient of concentration thereof inside.

In the above-mentioned reaction, a dispersant is preferably used when necessary.

The dispersant is not particularly limited, and surfactants, poor-water-soluble inorganic compound dispersants, polymeric protective colloid, etc. can be used. These can be used alone or in combination. Among these, the surfactants are preferably used.

The surfactants include anionic surfactants, cationic surfactants, nonionic surfactants, ampholytic surfactants, etc.

Specific of the anionic surfactants include alkylbenzene sulfonic acid salts, α-olefin sulfonic acid salts, ester phosphate, etc., and they preferably include a fluoroalkyl group. Specific examples of the anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc. Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNEDS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc. Specific examples of the cationic surfactants include amine salts such as alkyl amine salts, aminoalcohol fatty acid derivatives, polyamine fatty acid derivatives and imidazoline, and quaternary ammonium salts such as alkyltrimethyl ammonium salts, dialkyldimethyl ammonium salts, alkyldimethyl benzyl ammonium salts, pyridinium salts, alkyl isoquinolinium salts and benzethonium chloride. Among the cationic surfactants, primary, secondary and tertiary aliphatic amines having a fluoroalkyl group, aliphatic quaternary ammonium salts such as erfluoroalkyl(C6-C10) sulfoneamidepropyltrimethylammonium salts, benzalkonium salts, benzetonium chloride, pyridinium salts, imidazolinium salts, etc. are preferably used. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Specific examples of the nonionic surfactants include fatty acid amide derivatives, polyhydric alcohol derivatives, etc.

Specific examples of the ampholytic surfactants include as alanine, dodecyldi(aminoethyl)glycin, di(octylaminoethyle) glycin, and N-alkyl-N,N-dimethylammonium betaine.

Specific examples of the poor-water-soluble inorganic compound dispersants include tricalcium phosphate, calcium carbonate, titanium oxide, colloidal silica and hydroxyapatite, etc.

Specific examples of the polymeric protective colloid include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersion stabilizer, the calcium phosphate is dissolved with an acid such as a hydrochloric acid and washed with water to remove the calcium phosphate from the toner particle.

In the elongation or crosslinking reactions, catalysts such as dibutyltinlaurate and dioctyltinlaurate can be used.

Further, to decrease viscosity of a dispersion medium including the toner constituent, a solvent which can dissolve the prepolymer (A) or the unmodified polyester resin (ii) can be used because the resultant particles have a sharp particle diameter distribution. The solvent is preferably volatile from the viewpoint of being easily removed from the dispersion after the particles are formed.

Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used.

The usage of such solvents is from 0 to300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom under a normal or reduced pressure after the particles are subjected to an elongation reaction and/or a crosslinking reaction of the prepolymer.

The elongation and/or crosslinking reaction time depend on reactivity of the isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from the emulsified dispersion, a method of gradually raising the temperature of the whole dispersion to completely remove the organic solvent in the droplet by vaporizing can be used. Otherwise, a method of spraying the emulsified dispersion in dry air, completely removing a water-insoluble organic solvent from the droplet to form toner particles and removing the water dispersant by vaporizing can also be used. As the dry air, atmospheric air, nitrogen gas, carbon dioxide gas, a gaseous body in which a combustion gas is heated, and particularly various aerial currents heated to have a temperature not less than a boiling point of the solvent used are typically used. A spray dryer, a belt dryer and a rotary kiln can sufficiently remove the organic solvent in a short time.

When the emulsified dispersion is washed and dried while maintaining a wide particle diameter distribution thereof, the dispersion can be classified to have a desired particle diameter distribution.

A cyclone, a decanter, a centrifugal separation, etc. can remove particles in a dispersion liquid. The powder remaining after the dispersion liquid is dried can be classified, but the liquid is preferably classified in terms of efficiency. Unnecessary fine and coarse particles can be recycled to a kneading process to form particles.

The fine and coarse particles may be wet when recycled. The dispersant is preferably removed from the dispersion liquid, and more preferably removed at the same time when the above-mentioned classification is performed.

Heterogeneous particles such as release agent particles, charge controlling particles, fluidizing particles and colorant particles can be mixed with the toner powder after drying. Release of the heterogeneous particles from composite particles can be prevented by giving a mechanical stress to a mixed powder to fix and fuse them on a surface of the composite particles.

Specific methods include a method of applying an impact force on the mixture with a blade rotating at high-speed, a method of putting a mixture in a high-speed stream and accelerating the mixture such that particles thereof collide with each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

Known pigments and dyes having been used as colorants for toners can be used as colorants for use in the electrophotographic toner of the present invention. Specific examples of the colorants include carbon black, lamp black, iron black, cobalt blue, nigrosin dyes, aniline blue, phthalocyanine blue, phthalocyanine green, Hansa Yellow G, Rhodamine 6C Lake, chalco oil blue, chrome yellow, quinacridone red, benzidine yellow, rose Bengal, etc. These can be used alone or in combination. Further, to optionally impart magnetism to toner particles, magnetic components, i.e., iron oxides such as ferrite, magnetite and maghemite; metals such as iron, cobalt and nickel; or their alloyed metals with other metals are included in toner particles alone or in combination. In addition, these components can be used as colorants or with colorants.

The colorant in the toner of the present invention preferably has a number-average particle diameter not greater than 0.5 μm, more preferably not greater than 0.4 μm, and furthermore preferably not greater than 0.3 μm. When greater than 0.5 μm, the colorant does not have a sufficient dispersibility and the resultant toner does not have desired transparency. The colorant having a particle diameter less than 0.1 μm is basically considered not to have an adverse effect on light reflection and absorption of the resultant toner. The colorant having a particle diameter less than 0.1 μm contributes to transparency of an OHP sheet having good color reproducibility and image fixability. To the contrary, a large number of the colorants having a particle diameter greater than 0.5 μm tend to essentially deteriorate brightness and chromaticness of a projected image on an OHP sheet. Meanwhile, a large number of the colorants having a particle diameter greater than 0.5 μm are released from a surface of the toner particle, and tend to cause various problems such as background development, drum contamination and poor cleaning. The colorant having a number-average particle diameter not less than 0.7 μm is preferably not greater than 5% by number.

When the colorant is previously kneaded with a part or all of binder resins under the presence of a wetter, the colorant and the binder resins sufficiently adhere to each other and the colorant is effectively and stably dispersed even after any production process. The resultant toner includes well dispersed colorant, a small dispersion diameter thereof and has good transparency.

Specific examples of the binder resin include, but are not limited to, the modified and unmodified polyester resins mentioned above.

Specific examples of the method of previously kneading a mixture of the binder resin and the colorant with the wetter include a method of mixing the binder resin, the colorant and the wetter by a blender such as Henschel mixers; and kneading the mixture by a kneader such as two-roll and three-roll mills at a lower temperature than a melting point of the binder resin.

Specific examples of the wetter include typical organic solvents in consideration of solubility with the binder resin and wettability of the colorant. Particularly, organic solvents such as acetone, toluene, butanone or water are preferably used in terms of dispersibility of the colorant. Water is most preferably used in terms of environmental protection and the dispersion stability of the colorant in the following process of preparing a toner.

The method not only makes the colorant have a small particle diameter nut also increase uniformity of the dispersion status thereof, and which improves color reproducibility of images projected by OHP more.

The toner may include a release agent together with a toner binder and a colorant.

Specific examples of the release agent include known waxes, e.g., polyolefin waxes such as polyethylene wax and polypropylene wax; long chain carbon hydrides such as paraffin wax and sasol wax; and waxes including a carbonyl group. Among these waxes, the waxes including a carbonyl group are preferably used.

Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The release agent preferably has a melting point of from 40 to 160° C., more preferably of from 50 to 120° C., and furthermore preferably of from 60 to 90° C. A wax having a melting point less than 40° C. has an adverse effect on its high temperature preservability, and a wax having a melting point greater than 160° C. tends to cause cold offset of the resultant toner when fixed at a low temperature.

In addition, the release agent preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner.

A toner preferably includes the release agent in an amount of from 0 to 40% by weight, and more preferably from 3 to 30% by weight.

The toner may include a charge controlling agent to obtain sufficient charge quantity and improve charge buildability. Materials almost colorless or white are preferably used because colored materials cause a color change of the resultant toner. Specific examples of the charge controlling agent include known charge controlling agents such as triphenylmethane dyes, chelate compounds of molybdic acid, Rhodamine dyes, alkoxyamines, quaternary ammonium salts (including fluorine-modified quaternary ammonium salts), alkylamides, phosphor or compounds including phosphor, tungsten or compounds including tungsten, fluorine-containing activators, metal salts of salicylic acid, salicylic acid derivatives, etc. Specific examples of the marketed products of the charge controlling agents include BONTRON P-51 (quaternary ammonium salt), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

A content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images. These charge controlling agent can be dissolved and dispersed after kneaded upon application of heat together with a master batch pigment and resin, can be added when directly dissolved and dispersed in an organic solvent or can be fixed on a toner surface after the toner particles are produced.

Particulate resins may be added an aqueous medium when toner constituents are dispersed therein to stabilize the dispersibility.

Any thermoplastic and thermosetting resins can be used provided they can form an aqueous medium. Specific examples of the resins include vinyl resins, polyurethane resins, epoxy resins, polyester resins, polyamide resins, polyimide resins, silicon resins, phenol resins, melamine resins, urea resins, aniline resins, ionomer resins and polycarbonate resins. These resins can be used in combination. Among these resins, vinyl resins, polyurethane resins, epoxy resins, polyester resins and their combinations are preferably used because an aqueous medium including spherical particulate resins can easily be formed.

Specific examples of the vinyl resins include, but are not limited to, polymers formed of homopolymerized or copolymerized vinyl monomers such as styrene-(metha)esteracrylate resins, styrene-butadiene copolymers, (metha)acrylic acid-esteracrylate polymers, styrene-acrylonitrile copolymers, styrene-maleic acid anhydride copolymers and styrene-(metha)acrylic acid copolymers.

As an external additive for improving fluidity, developability and chargeability of the colored particles of the present invention, inorganic particulate materials are preferably used.

Specific examples of the inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

The inorganic particulate materials preferably have a primary particle diameter of from 5 nm to 2 μm, and more preferably from 5 nm to 500 nm. In addition, a specific surface area of the inorganic particulate materials measured by a BET method is preferably from 20 to 500 $m^2/g$. The content of the external additive is preferably from 0.01 to 5% by weight, and more preferably from 0.01 to 2.0% by weight, based on total weight of the toner composition.

Other than these materials, particulate polymers such as polystyrene formed by a soap-free emulsifying polymerization, a suspension polymerization or a dispersing polymerization, estermethacrylate or esteracrylate copolymers, silicone resins, benzoguanamine resins, polycondensation particulate materials such as nylon and polymer particles of thermosetting resins can be used.

The toner may include a fluidizer, i.e., surface treatment agents can increase hydrophobicity and prevent deterioration of fluidity and chargeability of the resultant toner even in high humidity. Specific examples of the surface treatment agents include silane coupling agents, sililating agents, silane coupling agents having an alkyl fluoride group, organic titanate coupling agents, aluminium coupling agents silicone oils and modified silicone oils.

In addition, the toner may include a cleanability improver for removing a developer remaining on a photoreceptor and an intermediate transfer medium after transferred. Specific examples of the cleanability improver include fatty acid metallic salts such as zinc stearate, calcium stearate and stearic acid; and particulate polymers prepared by a soap-free emulsifying polymerization method such as particulate polymethylmethacrylate and particulate polystyrene. The particulate polymers comparatively have a narrow particle diameter distribution and preferably have a volume-average particle diameter of from 0.01 to 1 μm.

The toner has good developing stability and produces high-quality toner images.

In addition, the image forming apparatus of the present invention can use an amorphous toner prepared by pulverization methods as well besides the polymerization toner. Constituents forming the toner prepared by the pulverization methods include those typically used in the electrophotographic toners without a particular limit.

Specific examples of binder resin for use in the toner prepared by pulverization methods include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; acrylic ester polymers and copolymers such as polymethylacrylate, polybutylacrylate, polymethylmethacrylate and polybutylmethacrylate; polyvinyl derivatives such as polyvinylchloride and polyvinylacetate; polyester polymers; polyurethane polymers; polyamide polymers; polyimide polymers; polyol polymers; epoxy polymers; terpene polymers; aliphatic or alicycle hydrocarbon resins; aromatic petroleum resins; etc. These can be used alone or in combination, but the resins are not limited thereto. Among these resins, at least a resin selected from the group consisting of styrene-acrylic copolymer resins, polyester resins and polyol resins is preferably used to impart good electric properties to the resultant toner and decrease production cost thereof. Further, the polyester resins and/or the polyol resins are more preferably used to impart good fixability to the resultant toner.

The toner prepared by the pulverization methods can be prepared by pre-mixing the colorant, wax, charge controlling agent with the resin when necessary to prepare a mixture, kneading the mixture at a temperature not higher than a melting point of the resin to prepare a kneaded mixture, cooling the kneaded mixture to prepare a hardened mixture and pulverizing the a hardened mixture. In addition, the external additives may be added to the toner when necessary.

The image developer may use a dry developing method or a wet developing method, and may develop a single color or multiple colors. For example, an image developer including a stirrer stirring the toner or developer to be charged and a rotatable magnet roller is preferably used.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visual image thereon.

The developer contained in the image developer may be a one-component developer or a two-component developer.

It is preferable that the visual image is firstly transferred onto an intermediate transferer and secondly transferred onto a recording medium thereby. It is more preferable that two or more visible color images are firstly and sequentially transferred onto the intermediate transferer and the resultant complex full-color image is transferred onto the recording medium thereby.

The visual image is transferred by the transferer using a transfer charger charging the electrostatic latent image bearer (photoreceptor). The transferer preferably includes a first transferer transferring the two or more visible color images onto the intermediate transferer and a second transferer transferring the resultant complex full-color image onto the recording medium.

The intermediate transferer is not particularly limited, and can be selected from known transferers in accordance with the purpose, such as a transfer belt.

The photoreceptor may be the intermediate transferer medium transferring toner images formed on photoreceptors to overlap colors and further transferring the overlapped color toner images onto a transfer medium, which is used when forming images by intermediate transfer methods.

The intermediate transferer medium is preferably has electroconductivity having a volume resistivity of from $10^5$ to $10^{11}$ Ω·cm. When less than $10^5$ Ω·cm, a toner image is distorted with a discharge when transferred from a photoreceptor onto the intermediate transferer medium. When greater than $10^{11}$ Ω·cm, an opposing charge of a toner image remains on the intermediate transferer medium after transferred therefrom to a transfer medium such as a paper, and occasionally appears as an accidental image on a following image.

The intermediate transferer medium can be prepared by kneading metal oxides such as tin oxide and indium oxide, electroconductive particulate materials such as carbon black or electroconductive particulate polymers alone or in combination with thermoplastic resins to prepare a mixture; and extruding the mixture to form a belt-shaped or cylindrical plastic. Besides, including the electroconductive particulate materials or electroconductive particulate polymers when necessary in a resin liquid including a crosslinkable monomer or oligomer to prepare a mixture, and centrifugally casting the mixture while heating to form an intermediate transferer medium in the shape of an endless belt.

When a surface layer is formed on the intermediate transferer medium, the materials except for the charge transport materials for forming the protection surface layer of a photoreceptor can be used, adjusting the resistivity with an electroconductive material when necessary.

The transferer (first transferer and second transferer) preferably includes at least a transfer means peeling and transferring the visual image formed on the photoreceptor onto the recording medium. The transferer may be one, or two or more, and includes a corona transferer using a corona discharge, a transfer belt, a transfer roller, a pressure transfer roller, an adhesive roller, etc.

The recording medium is not particularly limited, and can be selected from known recording media.

The protection layer forming process is a process of applying the protective material to the surface of a photoreceptor after transferring a toner image.

The protection layer former can be used as the protective material applicator.

The visual image transferred onto the recording medium is fixed thereon by a fixer. Each color toner image or the resultant complex full-color image may be fixed thereon.

The fixer is not particularly limited, can be selected in accordance with the purpose, and known heating and pressurizing means are preferably used. The heating and pressurizing means include a combination of a heating roller and a pressure roller, and a combination of a heating roller, a pressure roller and an endless belt, etc.

The heating temperature is preferably from 80 to 200° C.

In the present invention, a known optical fixer may be used with or instead of the fixer in accordance with the purpose.

The discharging process is a process of discharging the photoreceptor upon application of discharge bias with a discharger.

The discharger is not particularly limited, and can be selected from known dischargers, provided that the discharger can apply the discharge bias to the electrostatic latent image bearer, such as a discharge lamp.

The cleaning process is a process of removing a toner remaining on the photoreceptor with a cleaner.

The cleaner is preferably located downstream of the transferer and upstream of the protective material applicator.

The cleaner is not particularly limited, and can be selected from known cleaners, provided that the cleaner can remove the toner remaining thereon, such as a magnetic brush cleaner, an electrostatic brush cleaner, a magnetic roller cleaner, a blade cleaner, a brush cleaner and a web cleaner.

The recycling process is a process of recycling the toner removed in the cleaning process into the image developer with a recycler.

The recycler is not particularly limited, and known transporters can be used.

The controlling process is a process of controlling each of the processes with a controller.

The controller is not particularly limited, and can be selected in accordance with the purpose, provided the controller can control the above-mentioned means, such as a sequencer and a computer.

Figure 5:
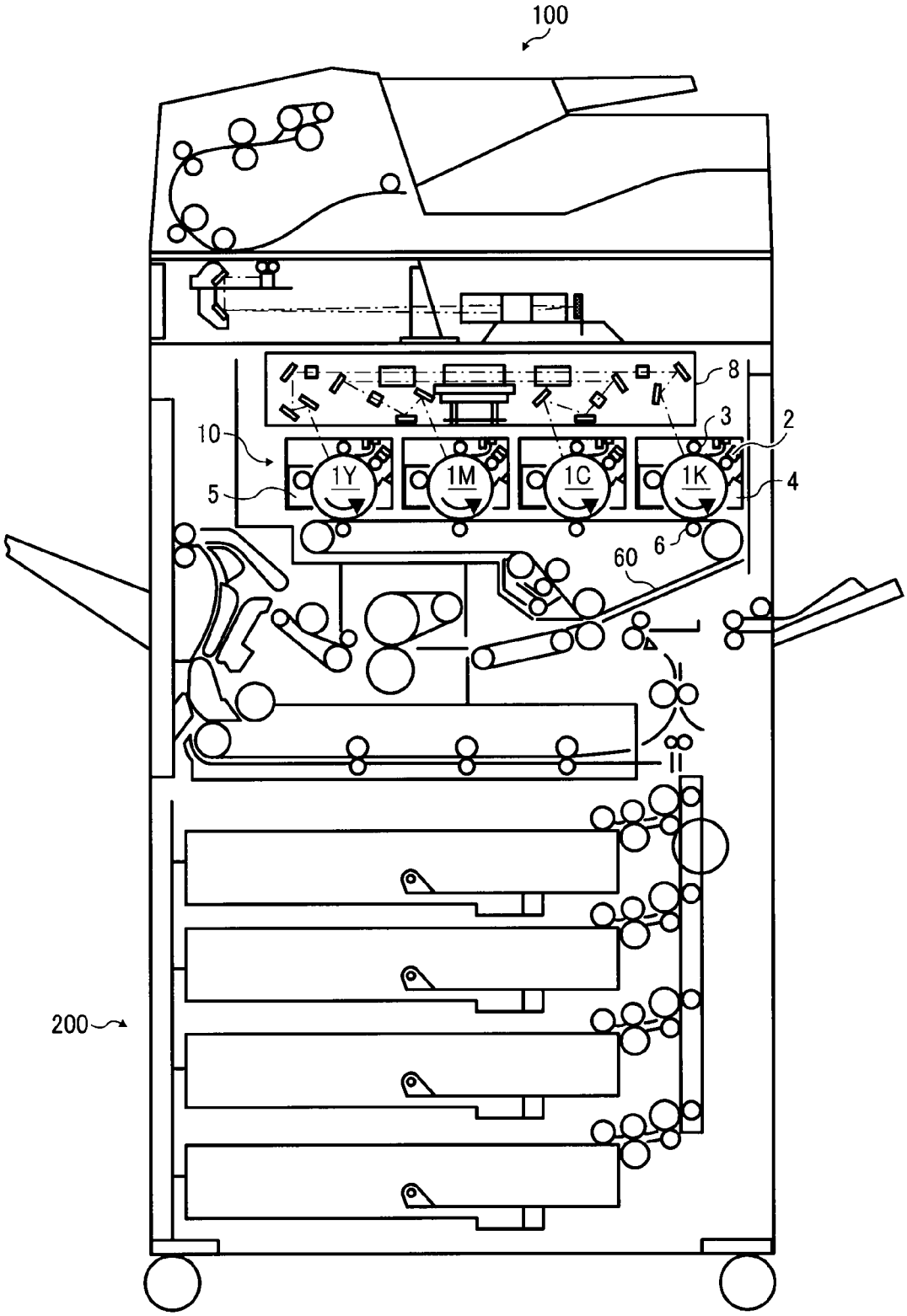
FIG. 5 is a schematic view illustrating an embodiment of the image forming apparatus using the protection layer former of the present invention.

FIG. 5 is a schematic view illustrating the image forming apparatus 100 including the protective material applicator of the present invention.

A protective material applicator 2, a charger 3, a latent image former 8, an image developer 5, a transferer 6 and a cleaner 4 are located around each of drum-shaped photoreceptors 1Y, 1M, 1C and 1K.

The operation in the image forming apparatus in FIG. 5 will be explained in a nega-posi process.

The photoreceptor typified by an organic image photoconductor (OPC) having an organic photoconductive layer is discharged by a discharge lamp (not shown) and negatively and evenly charged by the charger 3 having a charging member.

When the charger charges the photoreceptor, a voltage applicator (not shown) applies a suitable DC voltage or the DC voltage overlapped with an AC voltage to the charging member such that each of the photoreceptors 1Y, 1M, 1C and 1K has a desired potential.

Each of The charged photoreceptors 1Y, 1M, 1C and 1K is irradiated with a laser beam emitted by the laser scanning latent image former 8 to form a latent image thereon (a potential absolute value of an irradiated part is lower than that a non-irradiated part).

A laser beam emitted from a laser diode is deflected by polygonal polygon mirror, etc. rotating at a high speed, and scans the surface of each of the photoreceptors 1Y, 1M, 1C and 1K in the rotational direction thereof.

The thus formed latent image is developed with a toner or a developer including a toner and a carrier fed on the developing sleeve as a developer bearer of the image developer 5 to form a visual toner image.

When a latent image is developed, a voltage applicator (not shown) applies a suitable DC voltage or the DC voltage overlapped with an AC voltage to the developing sleeve between the irradiated part and non-irradiated part of each of the photoreceptors 1Y, 1M, 1C and 1K.

Each of the color toner images formed on each of the photoreceptors 1Y, 1M, 1C and 1K is transferred by the transferer 6 onto an intermediate transfer medium 60, and onto a recording medium such as a paper fed from a paper feeder 200.

The transferer 6 is preferably applied with a potential reverse to that of a toner as a transfer bias. Then, the intermediate transfer medium 60 is separated from the photoreceptor and a transferred image is obtained.

The toner remaining on the photoreceptor is collected by a cleaning member of the cleaner 4 to a toner collection chamber therein.

The image forming apparatus may be an apparatus forming plural toner images having different colors with plural image developers, transferring the toner images onto a transfer material, feeding them to a fixer and fixing the toner with heat, etc. or an apparatus sequentially transferring the plural toner images onto an intermediate transferer and transferring them onto recording medium such as a paper at a time.

The charger 3 is preferably located in contact with or close to the surface of a photoreceptor and a discharge wire is used therefor, which reduces ozone when charging much more than corona dischargers such as a corotron and a scorotron.

Such a charger located in contact with or close to the surface of a photoreceptor is likely to give much electrical stress thereto as a matte of course. However, an image forming apparatus including a protection layer former using the protective material block of the present invention stably produces quality images, preventing image variations due to time or use environment because of being able to maintaining a photoreceptor for long periods without deterioration.

As mentioned above, the image forming apparatus of the present invention having a large acceptable range of the surface variation of a photoreceptor and highly preventing variation of its chargeability to a photoreceptor can stably produce very high-quality images for long periods with the above-mentioned toner.

The process cartridge of the present invention includes at least a photoreceptor and the protective material applicator of the present invention, and optionally other means such as a charger, an irradiator, an image developer, a transferer, a cleaner and a discharger, and which is detachable from various electrophotographic image forming apparatuses and preferably detachable from the image forming apparatus of the present invention.

Figure 4:
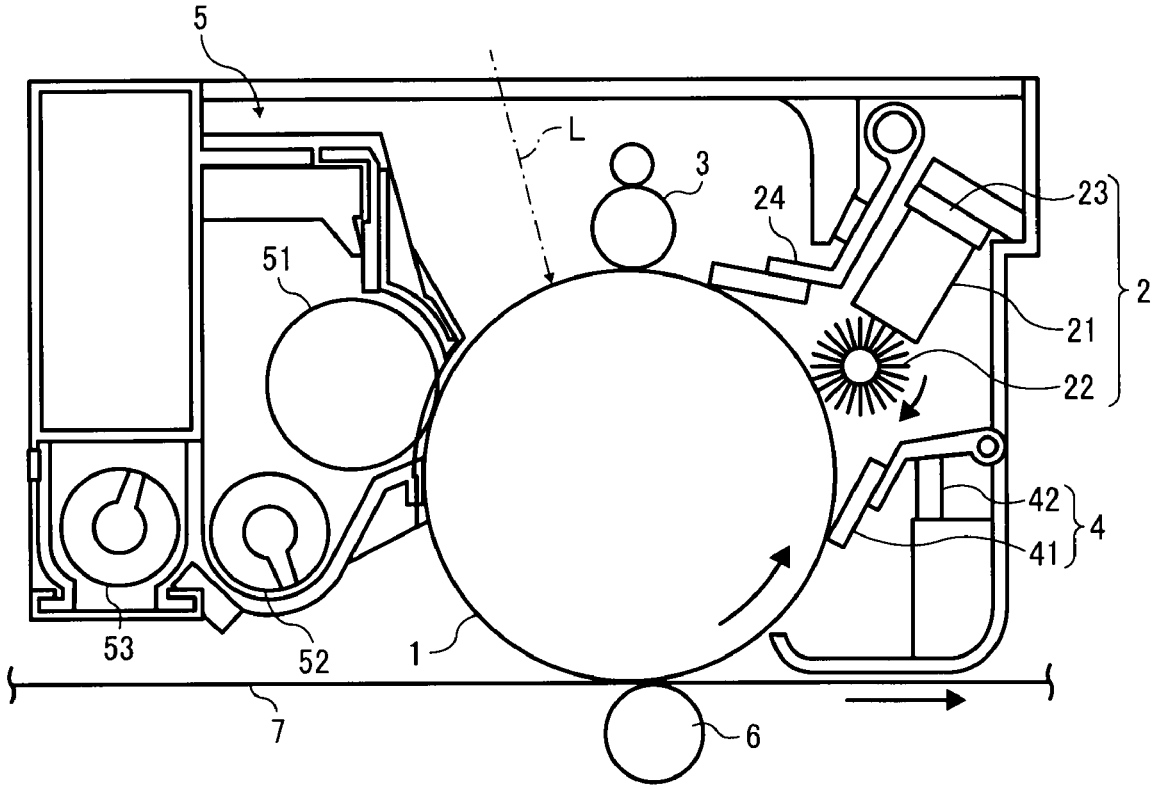
FIG. 4 is a schematic view illustrating an embodiment of a process cartridge using the protection layer former of the present invention.

FIG. 4 is a schematic view illustrating an embodiment of a process cartridge using the protection layer former of the present invention.

In FIG. 4, a protective material applicator 2 located facing the photoreceptor 1 mainly includes a protective material bar 21, a protective material application member 22, a pressure applicator 23 and a protection layer former 24. A cleaner 4 cleans the partially-deteriorated protective material and a toner remaining after transferred on the surface of the photoreceptor 1 with a cleaning member 41 and a cleaning presser 42. The cleaning member 41 contacts the photoreceptor at an angle like a (leading) counter type.

The protective material of the protective material bar 21 is applied by the protective material application member 22 to the surface of the photoreceptor the residual toner and deteriorated protective material is removed from by the cleaner, and the protection layer former 24 forms a film-shaped protection layer. The protective material is stably provided to the photoreceptor in a necessary and sufficient amount to efficiently protect the surface thereof and prevent deterioration thereof for long periods.

In FIG. 4, the protection layer former 24 is located in the trailing direction and may be located in the counter direction as shown in FIG. 3, and preferably located in the counter direction particularly when the linear speed of a photoreceptor is 180 mm/sec or more to quickly form a protection layer.

An electrostatic latent image is formed by irradiation with a laser beam L on the photoreceptor the protective material layer is formed on after charged. The electrostatic latent image is developed by an image developer 5 with a toner to form a visual toner image. The toner image is transferred by a transferer such as a transfer roller 6 out of the process cartridge onto a transfer medium 7.

As mentioned above, the process cartridge of the present invention having a large acceptable range of the surface variation of a photoreceptor and highly preventing variation of its chargeability to a photoreceptor can stably produce very high-quality images for long periods with the above-mentioned toner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Protective Material Block 1 (Comparative Example)

Zinc stearate was heated at 145° C. to be melted in a mold, and cooled to prepare a protective material block 1 having a depth of 40 mm, a width of 8 mm and a length of 350 mm.

Protective Material Block 2 (Example)

65 parts of stearic acid and 35 parts of palmitic acid were mixed to prepare a mixture. Zinc hydroxide was mixed with the mixture and dried to prepare particles including compatibilized zinc stearate and zinc palmitate and having a diameter of from 25 to 33 μm. The particles were partially dissolved in hydrochloric acid-methanol solution and heated at 80° C. to methylate the stearic acid and the palmitic acid. A ratio of the zinc stearate to the zinc palmitate was measured by gas chromatography. The weight ratio was 64/34.

The particles were placed in a compression mold and an ultrasonic vibration was applied thereto to uniformly disperse them therein. The particles were compressed from above until they have a thickness equivalent to 65% of a true specif ic gravity thereof and the compression was stopped for 5 sec. The particles were further compressed until they have a thickness equivalent to 80% of a true specific gravity thereof and the compression was stopped for 5 sec. Finally, the particles were further compressed until they have a thickness equivalent to 92% of a true specific gravity thereof to prepare a protective material block 2 having a depth of 40 mm, a width of 8 mm and a length of 350 mm.

The X-ray diffraction patterns of the protective material blocks 1 and 2 were measured by X-ray diffraction apparatus X' Pert PRO from Philips under the following conditions:

X-ray source: Cu—Kα

Wavelength of Kα1: 1.54056 Å

Wavelength of Kα2: 1.54439 Å

Kα2/Kα1: 0.5

Scan width (2θ): 5~100°

Step width (2θ): 0.02°

Voltage of X-ray dry bulb: 40 kV

Current of X-ray dry bulb: 40 mA

Incident, receiver slit: 1°

Smoothing: Nil

Figure 6:
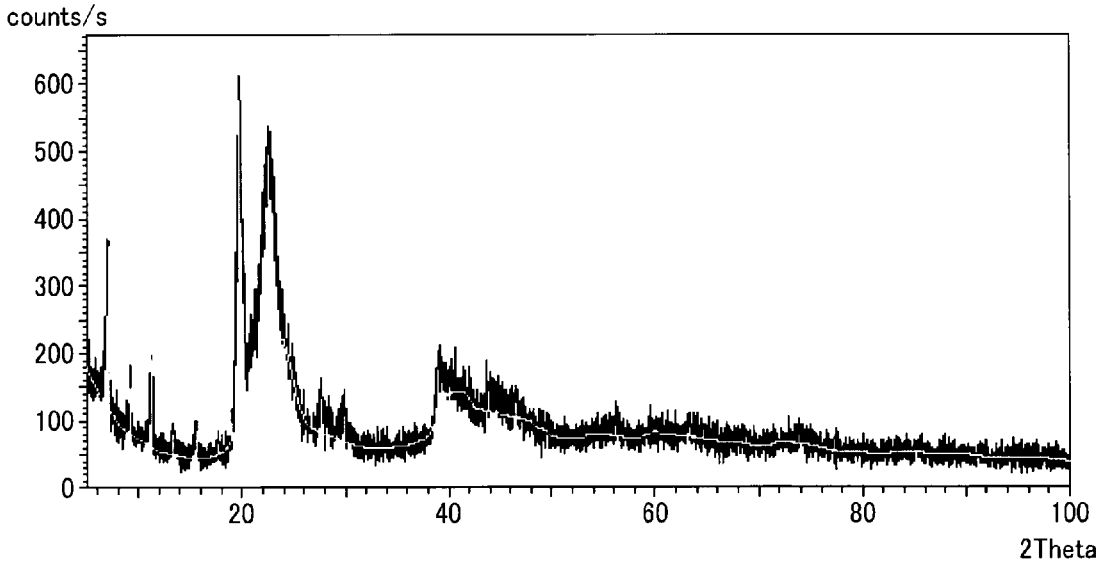
FIG. 6 is an X-ray diffraction pattern of a protective material block 1.
Figure 7:
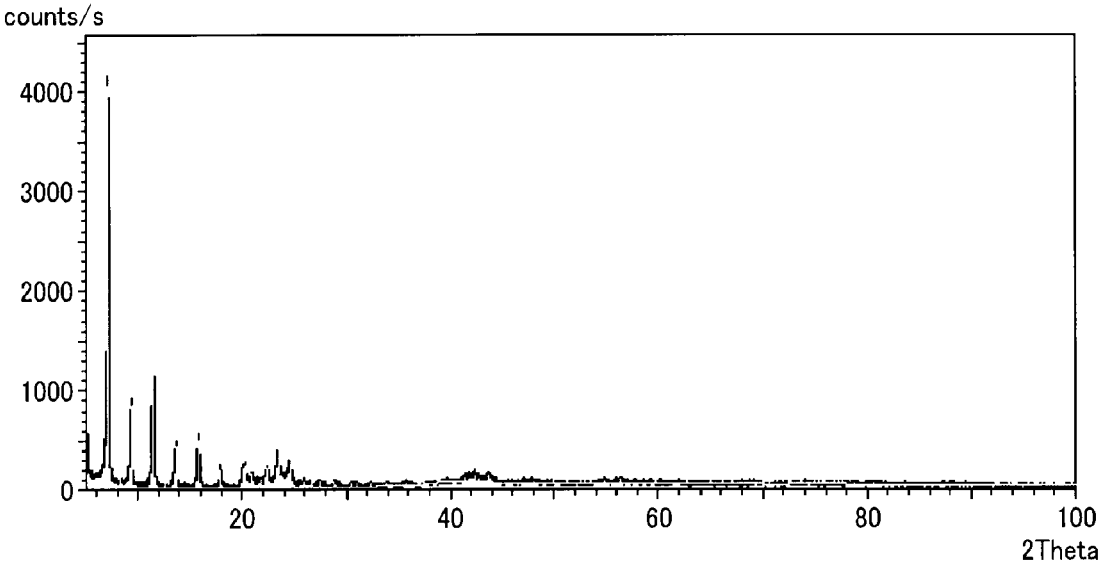
FIG. 7 is an X-ray diffraction pattern of a protective material block 2.

The X-ray diffraction patterns of the protective material blocks 1 and 2 are shown in FIGS. 6 and 7, respectively. Since Cu—Kα was used as a radiation source, the surface separation 2θ of from 11 to 16 Å was equivalent to 5.52 to 8.03°, and the surface separation 2θ of from 3.6 to 5.0 Å was equivalent to 17.72 to 24.72°.

In FIG. 6, the largest peak in the surface separation of from 11 to 16 Å was a surface separation of 12.6 Å (2θ: 7.0°), and he largest peak in the surface separation of from 3.6 to 5.0 Å was a surface separation of 4.50 Å (2θ: 19.7°). A ratio (P2/P1) of the maximum peak height (P2) in the surface separation of from 11 to 16 Å to the maximum peak height (P1) in the surface separation of from 3.6 to 5.0 Å was 2.0.

In FIG. 7, the largest peak in the surface separation of from 11 to 16 Å was a surface separation of 12.3 Å (2θ: 7.2°), and he largest peak in the surface separation of from 3.6 to 5.0 Å was a surface separation of 3.79 Å (2θ: 23.5°). The ratio (P2/P1) was 0.10.

Preparation of Photoreceptor

Photoreceptor 1

An undercoat coating liquid, a charge generation coating liquid and charge transport coating liquid, which have the following formulations, were coated and dried in this order on an aluminum drum (electroconductive substrate) having a diameter of 40 mm to form an undercoat layer 4.2 μm thick, a charge generation layer 0.15 μm thick, a charge transport layer 21 μm thick and a protection layer 4.0 μm thick thereon. The protection layer is formed by spray coating method and others by dip coating method.

Undercoat Layer Coating Liquid

| | |
|---|---|
| Alkyd resin (BEKKOZOL 1307-60-EL from Dainippon Ink & Chemicals, Inc.) | 6 |
| Melamine resin (SUPER BEKKAMIN G-821-60 from Dainippon Ink & Chemicals, Inc.) | 4 |
| Titanium dioxide | 40 |
| Methyl ethyl ketone | 200 |

CGL Coating Liquid

| | |
|---|---|
| Y-type oxotitanylphthalocyanine pigment | 2 |
| Polyvinylbutyral (S-LEC BM-S from Sekisui Chemical Co., Ltd.) | 0.2 |
| Tetrahydrofuran | 50 |

CTL Coating Liquid

| | |
|---|---|
| Bisphenol Z Polycarbonate (Panlite K1300 from TEIJIN CHEMICALS LTD.) | 10 |
| Low-molecular-weight charge transport material having the following formula: | 10 |

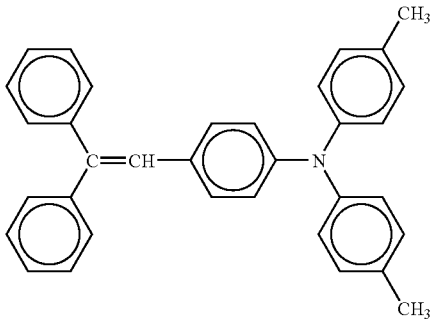

| | |
|---|---|
| Methylene chloride | 100 |

Protection Layer Coating Liquid

| | |
|---|---|
| Polycarbonate | 10 |
| Low-molecular-weight charge transport material having the above-mentioned formula | 7 |
| Particulate alumina having a center particle diameter (D50) of 0.3 μm | 6 |
| Dispersion aid (BYK-P104 from BYK-Chemie, Japan) | 0.08 |
| Tetrahydrofuran | 700 |
| Cyclohexanone | 200 |

Photoreceptor 2

The procedure for preparation of the photoreceptor 1 was repeated except for replacing 6 parts of alumina having a center particle diameter (D50) of 0.3 μm with 6.2 parts of alumina having a center particle diameter (D50) of 0.32 μm to prepare a photoreceptor 2.

Example 1 and Comparative Example 1

A tandem color image forming apparatus Imagio MPC3500 from Ricoh Company, Ltd. was modified such that the protective material application blade was located in the counter direction to the rotation direction of the photoreceptor 1 having a linear speed of 280 mm/sec as shown in FIG. 3. A DC voltage of −600 V overlapped with an AC voltage having a frequency of 2 kHz and an amplitude of 1.2 kV was applied to the photoreceptor from the charging roller. Each four process cartridges using the photoreceptor 1 and the protective material blocks 1 and 2 were prepared and installed in the modified tandem image forming apparatus. Five by five, 25,000 images of a test chart having an image area of 7% were produced totally at 23° C. and 45% RH. Namely, 5 images were produced first and the image forming apparatus was stopped, and again started to produce 5 mages. This operation was repeated to produce 25,000 images totally. Then, halftone yellow, cyan, magenta and black images were produced to evaluate them.

The image forming apparatus using the protective material block 2 produced high-quality halftone images of all the colors.

The image forming apparatus using the protective material block 1 produced striped abnormal cyan, magenta and black images, particularly the magenta and black images were apparently abnormal.

Protective Material Block 3 (Comparative Example)

Zinc stearate particles having a particle diameter of from 200 to 500 μm were placed in a compression mold and an ultrasonic vibration was applied thereto to uniformly disperse them therein. The particles were compressed from above until they have a thickness equivalent to 65% of a true specific gravity thereof and the compression was stopped for 5 sec. The particles were further compressed until they have a thickness equivalent to 81% of a true specific gravity thereof and the compression was stopped for 5 sec to prepare a protective material block 3 having a depth of 40 mm, a width of 8 mm and a length of 350 mm. The X-ray diffraction pattern of the protective material blocks 3 was measured as the protective material block 1 was. The ratio (P2/P1) was 0.62.

Protective Material Block 4 (Example)

Zinc stearate particles having a particle diameter of from 50 to 120 μm were placed in a compression mold and an ultrasonic vibration was applied thereto to uniformly disperse them therein. The particles were compressed from above until they have a thickness equivalent to 65% of a true specific gravity thereof and the compression was stopped for 5 sec. The particles were further compressed until they have a thickness equivalent to 82% of a true specific gravity thereof and the compression was stopped for 5 sec to prepare a protective material block 4 having a depth of 40 mm, a width of 8 mm and a length of 350 mm. The X-ray diffraction pattern of the protective material blocks 3 was measured as the protective material block 1 was. The ratio (P2/P1) was 0.44.

Example 2 and Comparative Example 2

A tandem color image forming apparatus Imagio MPC3500 from Ricoh Company, Ltd. was modified such that the protective material application blade was located in the counter direction to the rotation direction of the photoreceptor 1 having a linear speed of 170 mm/sec as shown in FIG. 3. A DC voltage of −600 V overlapped with an AC voltage having a frequency of 1.5 kHz and an amplitude of 1.2 kV was applied to the photoreceptor from the charging roller.

Each four process cartridges using the photoreceptor 1 and the protective material blocks 3 and 4 were prepared and installed in the modified tandem image forming apparatus. Five by five, 20,000 images of a test chart having an image area of 12% were produced totally at 20° C. and 45% RH. Then, halftone yellow, cyan, magenta and black images were produced to evaluate them.

The image forming apparatus using the protective material block 3 produced striped abnormal images of all colors, particularly the black image was not acceptable.

The image forming apparatus using the protective material block 4 produced high-quality halftone yellow, cyan and magenta images colors. However, slight abnormal stripes were observed on the black image although acceptable.

Protective Material Block 5 (Comparative Example)

Zinc stearate particles having a particle diameter of from 50 to 120 μm were placed in a compression mold heated to have a temperature of 90° C. and an ultrasonic vibration was applied thereto to uniformly disperse them therein. The particles were compressed from above until they have a thickness equivalent to 65% of a true specific gravity thereof and the compression was stopped for 5 sec. The particles were further compressed until they have a thickness equivalent to 100% of a true specific gravity thereof and left for 5 min to prepare a protective material block 4 having a depth of 40 mm, a width of 8 mm and a length of 350 mm.

The X-ray diffraction pattern of the protective material blocks 5 was measured as the protective material block 1 was. The ratio (P2/P1) was 1.2. Four process cartridges using the photoreceptor 1 and the protective material block 5 were prepared and installed in the modified tandem image forming apparatus. Five by five, 20,000 images of a test chart having an image area of 12% were produced totally at 20° C. and 45% RH. Then, halftone yellow, cyan, magenta and black images were produced to evaluate them to find that abnormal stripes were observed on all of the images.

Protective Material Blocks 6 to 11 (Examples)

Stearic acid and Palmitic acid were mixed at predetermined ratios to prepare mixtures. Zinc hydroxide was mixed with the mixture and dried to prepare particles including compatibilized zinc stearate and zinc palmitate and having a diameter of from 22 to 35 μm. The particles were partially dissolved in hydrochloric acid-methanol solution and heated at 80° C. to methylate the stearic acid and the palmitic acid. A ratio of the zinc stearate to the zinc palmitate was measured by gas chromatography.

The thus prepared particles including the zinc stearate and zinc palmitate compatible with each other were mixed with 19% by weight of boron nitride having a primary particle diameter of 0.2 μm and 3% by weight of particulate alumina having an average particle diameter of 0.28 μm by a blender to prepare a mixture, and the mixture was placed in a compression mold and an ultrasonic vibration was applied thereto to uniformly disperse the particulate zinc stearate and zinc palmitate therein. The particulate zinc stearate and zinc palmitate were compressed from above until they have a thickness equivalent to 67% of a true specific gravity thereof and the compression was stopped for 5 sec. The particulate zinc stearate and zinc palmitate were further compressed until they have a thickness equivalent to 89% of a true specific gravity thereof to prepare protective material blocks 6 to 11 having a depth of 40 mm, a width of 8 mm and a length of 350 mm.

TABLE 1

| | Zinc Stearate | Zinc Palmitate | P2/P1 |
|---|---|---|---|
| Protective material Block 6 | 66% by weight | 34% by weight | 0.12 |
| Protective material Block 7 | 60% by weight | 40% by weight | 0.20 |
| Protective material Block 8 | 56% by weight | 44% by weight | 0.14 |

TABLE 1-continued

| | Zinc Stearate | Zinc Palmitate | P2/P1 |
|---|---|---|---|
| Protective material Block 9 | 47% by weight | 53% by weight | 0.11 |
| Protective material Block 10 | 41% by weight | 59% by weight | 0.23 |
| Protective material Block 11 | 37% by weight | 63% by weight | 0.30 |

Examples 3 to 7

The image forming apparatus used in Example 1 was modified such that the photoreceptor had a linear speed of 220 mm/sec. 3. A DC voltage of −600 V overlapped with an AC voltage having a frequency of 1.9 kHz and an amplitude of 1.2 kV was applied to the photoreceptor from the charging roller.

Each four process cartridges using the photoreceptor 2 and the protective material blocks 6 to 11 were prepared and installed in the modified tandem image forming apparatus. Five by five, 30,000 images of a test chart having an image area of 5% were produced totally at 27° C. and 45% RH. Then, halftone yellow, cyan, magenta and black images were produced to evaluate them. The image forming apparatus using the protective material block 6 produced black images on which slight abnormal stripes were observed although acceptable. The image forming apparatus using the protective material blocks 7 to 10 produced high-quality halftone images of all the colors. The image forming apparatus using the protective material block 11 produced cyan and black images on which a dot was distorted when observed with a microscope although acceptable.

Protective Material Blocks 12 to 14

The protective material block 7 was modified to include 8% by weight of boron nitride having a primary particle diameter of 0.4 μm and 4% by weight of particulate alumina having an average particle diameter of 0.30 μm, and the final compression ratios were changed to prepare protective material blocks 12 to 14.

TABLE 2

| | Compression Ratio | P2/P1 |
|---|---|---|
| Protective material Block 12 | 82% | 0.39 |
| Protective material Block 13 | 93% | 0.12 |
| Protective material Block 14 | 97% | 0.09 |

Examples 8 to 10

The image forming apparatus used in Example 1 was modified such that the photoreceptor had a linear speed of 220 mm/sec.

3. A DC voltage of −600 V overlapped with an AC voltage having a frequency of 1.9 kHz and an amplitude of 1.2 kV was applied to the photoreceptor from the charging roller.

Each four process cartridges using the photoreceptor 2 and the protective material blocks 12 to 14 were prepared and installed in the modified tandem image forming apparatus. Five by five, 15,000 images of a test chart having an image area of 5% were produced totally at 15° C. and 25% RH. Then, halftone yellow, cyan, magenta and black images were produced to evaluate them. The image forming apparatus using the protective material blocks 12 to 14 produced high-quality halftone images of all the colors.

Photoreceptor 3

An undercoat coating liquid, a charge generation coating liquid and charge transport coating liquid, which have the following formulations, were coated and dried in this order on an aluminum drum (electroconductive substrate) having a diameter of 40 mm to form an undercoat layer 4.2 μm thick, a charge generation layer 0.15 μm thick, a charge transport layer 21 μm thick and a protection layer 4.6 μm thick thereon. The protection layer is formed by spray coating method and others by dip coating method.

Undercoat Layer Coating Liquid

| | |
|---|---|
| Alkyd resin (BEKKOZOL 1307-60-EL from Dainippon Ink & Chemicals, Inc.) | 6 |
| Melamine resin (SUPER BEKKAMIN G-821-60 from Dainippon Ink & Chemicals, Inc.) | 4 |
| Titanium dioxide | 40 |
| Methyl ethyl ketone | 200 |

CGL Coating Liquid

| | |
|---|---|
| Y-type oxotitanylphthalocyanine pigment | 2 |
| Polyvinylbutyral (S-LEC BM-S from Sekisui Chemical Co., Ltd.) | 0.2 |
| Tetrahydrofuran | 50 |

CTL Coating Liquid

| | |
|---|---|
| Bisphenol Z Polycarbonate (Panlite K1300 from TEIJIN CHEMICALS LTD.) | 10 |
| Low-molecular-weight charge transport material having the following formula: | 10 |

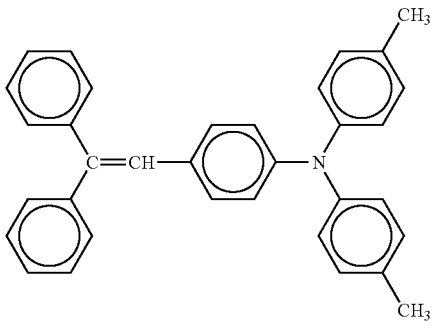

| | |
|---|---|
| Methylene chloride | 100 |

Protection Layer Coating Liquid

| | |
|---|---|
| Polycarbonate | 10 |
| Low-molecular-weight charge transport material having the above-mentioned formula | 7 |
| Particulate alumina having a center particle diameter (D50) of 0.3 μm | 6 |
| Dispersion aid (BYK-P104 from BYK-Chemie, Japan) | 0.08 |

-continued

| | |
|---|---|
| Tetrahydrofuran | 700 |
| Cyclohexanone | 200 |

Photoreceptor 4

The procedure for preparation of the photoreceptor 1 was repeated except for replacing 6 parts by weight of the particulate alumina having a center particle diameter (D50) of 0.3 μm with 6.2 parts by weight of a particulate alumina having a center particle diameter (D50) of 0.32 μm to prepare a photoreceptor 4.

In the following Examples and Comparative Examples, the average particle diameter of each of the particulate protective material was measured by Coulter counter.

Protective Material Block 21 (Comparative Example)

Zinc stearate was heated at 146° C. to be melted in a mold, and cooled to prepare a protective material block 21 having a depth of 12 mm, a width of 8 mm and a length of 350 mm. The X-ray diffraction pattern of the protective material blocks 21 was measured as the protective material block 1 was. The ratio (P2/P1) was 2.1.

Figure 9:
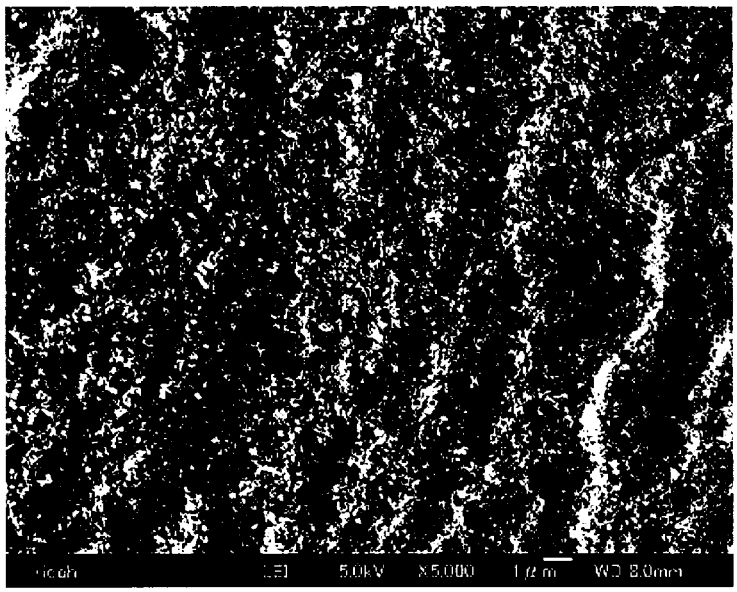
FIG. 9 is a scanning electron microscope (SEM) picture of a split face of the split protective material block of Comparative Example 21.

As shown in FIG. 8, the center of the protective material block in the longitudinal direction was cut to have a size of 4 mm×8 mm×10 mm by a jig saw. A groove was made on the side of the cut protective material block by a cutter knife, it was placed on a board convex upward with the groove up. A force was applied thereto from above to crack the protective material block. The cracked surface of the protective material block was observed by a field-emission scanning electron microscope (SEM) JSM-7400F from JEOL Ltd. at a magnification of 5,000 times to find no cleavage surface (FIG. 9).

Example 21

Protective Material Block 22

65 parts of stearic acid and 35 parts of palmitic acid were mixed to prepare a mixture. Zinc hydroxide was mixed with the mixture and dried to prepare particles including compatibilized zinc stearate and zinc palmitate and having a diameter of from 25 to 33 μm. The particles were partially dissolved in hydrochloric acid-methanol solution and heated at 80° C. to methylate the stearic acid and the palmitic acid. A ratio of the zinc stearate to the zinc palmitate was measured by gas chromatography. The weight ratio was 64/34.

The particles were placed in a compression mold and an ultrasonic vibration was applied thereto to uniformly disperse them therein. The particles were compressed from above until they have a thickness equivalent to 65% of a true specific gravity thereof and the compression was stopped for 5 sec. The particles were further compressed until they have a thickness equivalent to 80% of a true specific gravity thereof and the compression was stopped for 5 sec. Finally, the particles were further compressed until they have a thickness equivalent to 92% of a true specific gravity thereof to prepare a protective material block 22 having a depth of 40 mm, a width of 8 mm and a length of 350 mm. The X-ray diffraction pattern of the protective material blocks 22 was measured as the protective material block 1 was. The ratio (P2/P1) was 0.13.

The protective material block 22 was cracked as the protective material block 21 was, and the cracked surface was observed by a SEM at a magnification of 1,000 times. An area of the cleavage surface thereof measured by image processing was from 230 to 750 $\mu m^2$, and the total area thereof was 78% of the cross-section of the protective material block.

Example 22

Protective Material Block 23

Zinc stearate particles having an average particle diameter of from 22 μm were placed in a compression mold and an ultrasonic vibration was applied thereto to uniformly disperse them therein. The particles were compressed from above until they have a thickness equivalent to 65% of a true specific gravity thereof and the compression was stopped for 5 sec. The particles were further compressed until they have a thickness equivalent to 83% of a true specific gravity thereof to prepare a protective material block 23 having a depth of 11 mm, a width of 8 mm and a length of 350 mm. The X-ray diffraction pattern of the protective material blocks 23 was measured as the protective material block 1 was. The ratio (P2/P1) was 0.37.

The protective material block 23 was cracked as the protective material block 21 was, and the cracked surface was observed by a SEM. An area of the cleavage surface thereof measured by image processing was from 50 to 680 $\mu m^2$, and the total area thereof was 83% of the cross-section of the protective material block.

Comparative Example 22

Protective Material Block 24

Zinc stearate particles having a particle diameter of from 50 to 120 μm were placed in a compression mold heated to have a temperature of 90° C. and an ultrasonic vibration was applied thereto to uniformly disperse them therein. The particles were compressed from above until they have a thickness equivalent to 65% of a true specific gravity thereof and the compression was stopped for 5 sec. The particles were further compressed until they have a thickness equivalent to 100% of a true specific gravity thereof and left for 10 min to prepare a protective material block 24 having a width of 12 mm, a height of 8 mm and a length of 350 mm. The X-ray diffraction pattern of the protective material blocks 24 was measured as the protective material block 1 was. The ratio (P2/P1) was 0.56.

The protective material block 24 was cracked as the protective material block 21 was, and the cracked surface was observed by a SEM. No cleavage surface was observed by image processing although defects were observed everywhere thereon.

Protective Material Block 25

Zinc stearate particles having a particle diameter of 18 μm were placed in a compression mold heated to have a temperature of 90° C. and an ultrasonic vibration was applied thereto to uniformly disperse them therein. The particles were compressed from above until they have a thickness equivalent to 65% of a true specific gravity thereof and the compression was stopped for 5 sec. The particles were further compressed until they have a thickness equivalent to 98% of a true specific gravity thereof and left for 5 min to prepare a protective material block 24 having a depth of 12 mm, width of 8 mm and a length of 350 mm. The X-ray diffraction pattern of the protective material blocks 25 was measured as the protective material block 1 was. The ratio (P2/P1) was 0.09.

The protective material block 25 was cracked as the protective material block 21 was, and the cracked surface was observed by a SEM. An area of the cleavage surface thereof measured by image processing was from 80 to 650 $\mu m^2$, and the total area thereof was 41% of the cross-section of the protective material block.

Examples 24 to 29

Protective Material Blocks 26 to 31

Stearic acid and Palmitic acid were mixed at ratios ahown in Table 3 to prepare mixtures. Zinc hydroxide was mixed with the mixture and dried to prepare particles including compatibilized zinc stearate and zinc palmitate and having a diameter of from 15 to 35 μm. The particles were partially dissolved in hydrochloric acid-methanol solution and heated at 80° C. to methylate the stearic acid and the palmitic acid. A ratio of the zinc stearate to the zinc palmitate was measured by gas chromatography.

The thus prepared particles including the zinc stearate and zinc palmitate compatible with each other were mixed with 18% by weight of boron nitride having a primary particle diameter of 0.4 μm and 2% by weight of particulate alumina having an average particle diameter of 0.29 μm by a blender to prepare a mixture, and the mixture was placed in a compression mold and an ultrasonic vibration was applied thereto to uniformly disperse the particulate zinc stearate and zinc palmitate therein. The particulate zinc stearate and zinc palmitate were compressed from above until they have a thickness equivalent to 60% of a true specific gravity thereof and the compression was stopped for 5 sec. The particulate zinc stearate and zinc palmitate were further compressed until they have a thickness equivalent to 94% of a true specific gravity thereof to prepare protective material blocks 26 to 31 having a depth of 9 mm, width of 8 mm and a length of 350 mm. The X-ray diffraction patterns of the protective material blocks 26 to 31 were measured as the protective material block 1 was to determine the ratios (P2/P1).

The protective material blocks 26 to 31 were cracked as the protective material block 21 was, and the cracked surfaces were observed by a SEM. Area of the cleavage surfaces thereof was measured by image processing. The results are shown in Table 3.

TABLE 3

| | Protective material Block | Zinc Stearate | Zinc Palmitate | P2/P1 | Cleavage surface area | Cleavage surface area ratio |
|---|---|---|---|---|---|---|
| Example 24 | Protective material Block 26 | 66% by weight | 66% by weight | 0.11 | 75 to 580 | 59% |
| Example 25 | Protective material Block 27 | 60% by weight | 66% by weight | 0.10 | 60 to 520 | 63% |
| Example 26 | Protective material Block 28 | 56% by weight | 66% by weight | 0.11 | 70 to 730 | 68% |
| Example 27 | Protective material Block 29 | 47% by weight | 66% by weight | 0.12 | 60 to 910 | 65% |
| Example 28 | Protective material Block 30 | 41% by weight | 66% by weight | 0.11 | 50 to 840 | 61% |
| Example 29 | Protective material Block 31 | 37% by weight | 66% by weight | 0.10 | 45 to 820 | 68% |

Examples 30 to 32

Protective Material Blocks 32 to 34

The protective material block 27 in Example 25 was modified to include 8% by weight of boron nitride having a primary particle diameter of 0.4 μm and 4% by weight of particulate alumina having an average particle diameter of 0.30 μm, and the final compression ratios were changed as shown in Table 4 to prepare protective material blocks 32 to 34. The X-ray diffraction patterns of the protective material blocks 32 to 34 were measured as the protective material block 1 was to determine the ratios (P2/P1).

The protective material blocks 32 to 34 were cracked as the protective material block 21 was, and the cracked surfaces were observed by a SEM. Area of the cleavage surfaces thereof was measured by image processing. The results are shown in Table 4.

TABLE 4

| | Protective material Block | Compression Ratio | P2/P1 | Cleavage surface area | Cleavage surface area ratio |
|---|---|---|---|---|---|
| Example 30 | Protective material Block 32 | 83% | 0.30 | 70 to 580 | 58% |
| Example 31 | Protective material Block 33 | 93% | 0.11 | 60 to 530 | 65% |
| Example 32 | Protective material Block 34 | 96% | 0.09 | 70 to 740 | 69% |

Example 33 and Comparative Example 23

A tandem color image forming apparatus Imagio MPC3500 from Ricoh Company, Ltd. was modified such that the protective material application blade was located in the counter direction to the rotation direction of the photoreceptor 1 having a linear speed of 280 mm/sec as shown in FIG. 3. A DC voltage of −600 V overlapped with an AC voltage having a frequency of 2 kHz and an amplitude of 1.2 kV was applied to the photoreceptor from the charging roller.

Each four process cartridges using the photoreceptor 3 and the protective material blocks 21 and 22 were prepared and installed in the modified tandem image forming apparatus.

A polymerized toner having an average particle diameter of 3.6 μm and an average circularity of 0.97 was used.

Five by five, 25,000 images of a test chart having an image area of 7% were produced totally at 22° C. and 44% RH. Namely, 5 images were produced first and the image forming apparatus was stopped, and again started to produce 5 mages. This operation was repeated to produce 25,000 images totally. Then, halftone yellow, cyan, magenta and black images were produced to evaluate them.

The image forming apparatus using the protective material block 22 produced high-quality halftone images of all the colors.

The image forming apparatus using the protective material block 21 produced striped abnormal cyan, magenta and black images, particularly the magenta and black images were apparently abnormal.

Example 34 and Comparative Example 24

A tandem color image forming apparatus Imagio MPC3500 from Ricoh Company, Ltd. was modified such that the protective material application blade was located in the counter direction to the rotation direction of the photoreceptor 1 having a linear speed of 170 mm/sec as shown in FIG. 2. A DC voltage of −600 V overlapped with an AC voltage having a frequency of 1.6 kHz and an amplitude of 1.2 kV was applied to the photoreceptor from the charging roller.

A polymerized toner having an average particle diameter of 3.5 μm and an average circularity of 0.96 was used.

Each four process cartridges using the photoreceptor 3 and the protective material blocks 23 and 21 were prepared and installed in the modified tandem image forming apparatus. Five by five, 20,000 images of a test chart having an image area of 12% were produced totally at 20° C. and 45% RH. Then, halftone yellow, cyan, magenta and black images were produced to evaluate them.

The image forming apparatus using the protective material block 21 produced striped abnormal images of all colors, particularly the black image was not acceptable.

The image forming apparatus using the protective material block 23 produced high-quality half tone yellow, cyan and magenta images colors. However, slight abnormal stripes were observed on the black image although acceptable.

Example 35 and Comparative Example 25

Each four process cartridges using the photoreceptor 3 and the protective material blocks 24 and 25 were prepared and installed in the modified tandem image forming apparatus.

A polymerized toner having an average particle diameter of 3.6 μm and an average circularity of 0.96 was used.

Five by five, 20,000 images of a test chart having an image area of 12% were produced totally at 20° C. and 40% RH.

Then, halftone yellow, cyan, magenta and black images were produced to evaluate them.

The image forming apparatus using the protective material block 24 produced striped abnormal images of all colors.

The image forming apparatus using the protective material block 25 produced striped magenta and black images.

Example 36 to 41

A tandem color image forming apparatus Imagio MPC3500 from Ricoh Company, Ltd. was modified such that the photoreceptor had a linear speed of 220 mm/sec. ADC voltage of −600 V overlapped with an AC voltage having a frequency of 1.9 kHz and an amplitude of 1.25 kV was applied to the photoreceptor from the charging roller.

A polymerized toner having an average particle diameter of 3.6 μm and an average circularity of 0.96 was used.

Each four process cartridges using the photoreceptor 2 and the protective material blocks 26 to 31 were prepared and installed in the modified tandem image forming apparatus. Five by five, 30,000 images of a test chart having an image area of 5% were produced totally at 27° C. and 45% RH. Then, halftone yellow, cyan, magenta and black images were produced to evaluate them.

The image forming apparatus using the protective material block 26 produced only slight striped black images although acceptable.

The image forming apparatus using the protective material blocks 27 to 30 produced high-quality images of all colors.

The image forming apparatus using the protective material block 31 produced cyan and black images on which a dot was distorted when observed with a microscope although acceptable.

Example 42 to 44

A tandem color image forming apparatus Imagio MPC3500 from Ricoh Company, Ltd. was modified such that the photoreceptor had a linear speed of 220 mm/sec. ADC voltage of −600 V overlapped with an AC voltage having a frequency of 1.9 kHz and an amplitude of 1.2 kV was applied to the photoreceptor from the charging roller.

A polymerized toner having an average particle diameter of 3.5 μm and an average circularity of 0.96 was used.

Each four process cartridges using the photoreceptor 4 and the protective material blocks 12 to 14 were prepared and installed in the modified tandem image forming apparatus. Five by five, 15,000 images of a test chart having an image area of 5% were produced totally at 18° C. and 25% RH. Then, halftone yellow, cyan, magenta and black images were produced to evaluate them.

The image forming apparatus using the protective material blocks 32 to 34 produced high-quality images of all colors.

Example 51

Protective Material Block 51

A mixture including 64 parts by weight of zinc stearate and 36 parts by weight of zinc palmitate was mixed with particulate aluminum oxide AA-05 having an average particle diameter of 0.5 μm from Sumitomo Chemical Co., Ltd., according to weight ratios in the following Table by Wonder Blender WB-1 from OSAKA CHEMICAL Co., Ltd. at 25,000 rpm for 10 sec twice to prepare a mixed powder.

From the specific gravity, blending ratio and desired filling rate preliminarily measured, an amount of the mixture powder to be placed in a mold was determined. In this example, a protective material block was prepared from 23.9 g of the mixed powder with the following procedure.

The mixed powder was placed in an aluminum mold having a depth of 29 mm, a width of 8 mm and a length of 350 mm and compressed by a press such that the filled had a height of 8 mm to consolidate the powder after smoothing the surface of the powder.

The consolidated protective material was taken out from the mold, reformed to 8 mm×8 mm×310 mm, and attached to a metallic substrate to prepare a protective material block 51.

The X-ray diffraction pattern of the protective material block 51 was measured as the protective material block 1 was to determine the ratios (P2/P1).

Protective Material Blocks 52 to 58

The procedure for preparation and of the protective material block 51 in Example 51 was repeated except for changing the materials, mixing ratio of the mixture and the amount of input thereof as shown in the following Table 51 to prepare protective material blocks 52 to 58.

The properties of the protective material blocks were measured as follows.

A continuous bubble fraction and an independent bubble fraction of each of the protective material blocks were measured as follows.

1. 3 pieces of rectangulars of 5 cm×8 mm×8 mm were cut out from the protective material block.

2. The size of the protective material block was measured with a side gauge, and an apparent volume V1 ($cm^3$) including the continuous bubble and the independent bubble.

3. The weight W1 (g) of the protective material block was measured.

4. All the protective material blocks were placed in Beckman air comparison densitometer from Tokyoscience Co., Ltd. to obtain an apparent volume V2 ($cm^3$) including the independent bubble.

5. The sample, the V1 and V2 of which were measured, was pulverized until the independent bubble disappeared, and a part of which was precisely weighed W2 (g).

6. The pulverized sample was placed in Beckman air comparison densitometer to obtain a volume V3 ($cm^3$) of the protective material W2 (g) not including bubble.

7. The continuous bubble fraction and the independent bubble fraction were determined by the following formulae:

$$\textit{Continuous bubble fraction} = 100 \times (V1 - V2)/V1 \text{ (volume \%)}$$

$$\textit{Independent bubble fraction} = 100 \times [V2 - V3 \cdot (W1/W2)] \text{ (volume \%)}.$$

The properties were measured under an environment of 20° C. and 50% RH. The continuous bubble fraction and the independent bubble fraction of each of the protective materials are shown in the following Table 51.

TABLE 51

| | | C1 | | C2 | | | | | | | |
|---|---|---|---|---|---|---|---|---|---|---|---|
| Ex | | M | WR | M | PD | WR | HT | WT (g) | CBF | IBF | P2/P1 |
| 51 | P51 | MSP | 90 | Al | 0.5 | 10 | No | 23.9 | 9.8 | 0.0 | 0.12 |
| 52 | P52 | MSP | 90 | Al | 0.5 | 10 | No | 22.6 | 14.9 | 0.0 | 0.39 |
| 53 | P53 | MSP | 90 | Al | 0.5 | 10 | No | 25.7 | 3.0 | 0.1 | 0.08 |
| 54 | P54 | MSP | 90 | Al | 1.5 | 10 | No | 23.8 | 10.0 | 0.0 | 0.14 |
| 55 | P55 | MSP | 90 | Al | 0.1 | 10 | No | 23.9 | 9.7 | 0.1 | 0.13 |
| 56 | P56 | MSP | 90 | Al | 3.0 | 10 | No | 23.8 | 10.1 | 0.0 | 0.15 |
| Co51 | P57 | ZS | 100 | — | — | — | MM | 24.6 | 0.0 | 0.0 | 2.6 |
| Co52 | P58 | ZS | 100 | Al | 0.5 | 10 | MM | 26.5 | 0.0 | 0.0 | 2.4 |

Ex: Example
Co: comparative Example
MSP: Mixture of Zinc stearate and zinc palmitate (64:36)
C1: Constituent 1
C2: Constituent 2
WR: Weight Ratio
M: Material
PD: Particle Diameter
HT: Heat treatment
WT: Weight
CBF: Continuous bubble fraction
IBF: Independent bubble fraction
Al: Alumina AA-05
MM: Melt molded (160° C.)

Next, around a photoreceptor, following to a transfer process, a counter-type cleaning blade, a brush-shaped protective material applicator using the protective material block 51 and a trailing-type protection layer former are located in this order from upstream to prepare a process cartridge.

The process cartridge was installed in an image forming apparatus (imagio Neo C600 from Ricoh Company, Ltd.) modified to include the process cartridge, and 100,000 pieces of an A4 image having an image area of 6% were continuously produced. The images were evaluated in environments of 20° C. and 50% RH, 10° C. and 25% RH, and 35° C. and 80% RH.

A polymerized toner having a weight-average particle diameter (D4) of 5.1 μm, a number-average particle diameter (D1) of 4.3 μm, a ratio (D4/D1) of 1.19 and average circularity of 0.98 was used.

Striped abnormal images, uneven halftone images and blurred images related to the cleanability were evaluated according to the following standards.

<Striped Abnormal Images> (St)

◎: Very good
○: Good
Δ: Acceptable
×: Unusable

<Uneven Halftone Images> (UH)

◎: Very good
○: Good
Δ: Acceptable
×: Unusable

<Blurred Images> (Bl)

◎: very good
○: Good
Δ: Acceptable
×: Unusable

After 100,000 images were produced, whether foreign particles adhered to the surface of the protective material was visually observed and evaluated according to the following standard.

◎: No adherence
○: Slightly adhered
Δ: Spottedly adhered
×: Widely adhered

Further, deterioration of the photoreceptor, the cleaning blade and the charger were observed according to the following standard before and after 100,000 images were produced.

○: Unchanged
Δ: Slightly deteriorated (practically usable)
×: Deteriorated

The photoreceptor, the cleaning blade and the charger did not deteriorate and produced quality images even after producing 100,000 images.

The image evaluation results and the observation results of the deterioration are shown in the following Tables 52 to 54 including the following Examples and Comparative Examples.

In addition, the image forming apparatus using the protective material block 51 continuously produced 500,000 quality images, and the mage bearer, the cleaning blade and the charger hardly deteriorated.

Example 57

The procedure for the image evaluation in Example 52 was repeated except for changing the pressure of the applicator to 0.8 times as much as that in Example 52 because the protective material was provided too much. The protection effect was as good as that of Example 51.

Example 58

The procedure for the image evaluation in Example 53 was repeated except for changing the pressure of the applicator to 1.2 times as much as that in Example 53 because the protective material was not provided enough. The protection effect was as good as that of Example 51.

Comparative Examples 51 and 52

The procedure for the image evaluation in Example 51 was repeated except for replacing the protective material block 51 with the protective material blocks 57 and 58.

TABLE 52

| Initial Image | 20° C. 50% RH | | | 10° C. 25% RH | | | 35° C. 80% RH | | |
|---|---|---|---|---|---|---|---|---|---|
| | St | UH | Bl | St | UH | Bl | St | UH | Bl |
| Ex. 51 | ◎ | ◎ | ◎ | ◎ | ◎ | ◎ | ◎ | ◎ | ◎ |
| Ex. 52 | ◎ | ◎ | ◎ | ◎ | ◎ | ◎ | ◎ | ◎ | ◎ |
| Ex. 53 | ◎ | ◎ | ◎ | ◎ | ◎ | ◎ | ◎ | ◎ | ◎ |
| Ex. 54 | ◎ | ◎ | ◎ | ◎ | ◎ | ◎ | ◎ | ◎ | ◎ |
| Ex. 55 | ◎ | ◎ | ◎ | ◎ | ◎ | ◎ | ◎ | ◎ | ◎ |
| Ex. 56 | ◎ | ◎ | ◎ | ◎ | ◎ | ◎ | ◎ | ◎ | ◎ |
| Ex. 57 | ◎ | ◎ | ◎ | ◎ | ◎ | ◎ | ◎ | ◎ | ◎ |
| Ex. 58 | ◎ | ◎ | ◎ | ◎ | ◎ | ◎ | ◎ | ◎ | ◎ |
| Ex. 59 | ◎ | ◎ | ◎ | ◎ | ◎ | ◎ | ◎ | ◎ | ◎ |
| Com. Ex. 51 | ◎ | ◎ | ◎ | ○ | ◎ | ◎ | ◎ | ◎ | ◎ |
| Com. Ex. 52 | ◎ | ◎ | ◎ | ○ | ◎ | ◎ | ◎ | ◎ | ◎ |

TABLE 53

| After 100,000 | 20° C. 50% RH | | | 10° C. 25% RH | | | 35° C. 80% RH | | | |
|---|---|---|---|---|---|---|---|---|---|---|
| | St | UH | Bl | St | UH | Bl | St | UH | Bl | UPC |
| Ex. 51 | ◎ | ◎ | ◎ | ◎ | ◎ | ◎ | ◎ | ◎ | ◎ | ◎ |
| Ex. 52 | ◎ | ◎ | ◎ | ○ | ○ | ◎ | ◎ | ◎ | ◎ | ◎ |
| Ex. 53 | ◎ | ○ | ◎ | ◎ | ○ | ◎ | ◎ | ◎ | ◎ | ◎ |
| Ex. 54 | ○ | ◎ | ◎ | ○ | ◎ | ◎ | ◎ | ◎ | ◎ | ◎ |
| Ex. 55 | ◎ | ◎ | ◎ | ◎ | ◎ | ◎ | ◎ | ◎ | ◎ | ◎ |
| Ex. 56 | Δ | ◎ | ◎ | Δ | ◎ | ◎ | ◎ | ◎ | ◎ | ◎ |
| Ex. 57 | ◎ | ◎ | ◎ | ◎ | ◎ | ◎ | ◎ | ◎ | ◎ | ◎ |
| Ex. 58 | ◎ | ◎ | ◎ | ◎ | ◎ | ◎ | ◎ | ◎ | ◎ | ◎ |
| Ex. 59 | ◎ | ◎ | ◎ | ○ | ○ | ◎ | ◎ | ◎ | ◎ | ◎ |
| Com. Ex. 51 | X | Δ | Δ | X | X | ◎ | Δ | X | X | X |
| Com. Ex. 52 | Δ | Δ | ○ | X | X | ◎ | Δ | X | X | X |

PC: Uniformity of protective material consumption

TABLE 54

| After 10,000 | Photoreceptor | Cleaner | Charger |
|---|---|---|---|
| Example 51 | ○ | ○ | ○ |
| Example 52 | ○ | Δ | Δ |
| Example 53 | Δ | Δ | ○ |
| Example 54 | Δ | Δ | ○ |

TABLE 54-continued

| | After 10,000 | | |
|---|---|---|---|
| | Photoreceptor | Cleaner | Charger |
| Example 55 | Δ | ○ | Δ |
| Example 56 | Δ | Δ | Δ |
| Example 57 | ○ | ○ | ○ |
| Example 58 | ○ | ○ | ○ |
| Example 59 | ○ | Δ | Δ |
| Comparative Example 51 | X | X | X |
| Comparative Example 52 | X | X | X |

Example 101

Protective Material Block 101

A mixture including 69 parts by weight of zinc stearate and 31 parts by weight of zinc palmitate (number standard 50% particle diameter of 50 μm), boron nitride (number standard 50% particle diameter of 5 μm) and particulate aluminum oxide (number standard 50% particle diameter of 0.5 μm) were mixed according to weight ratios in the following Table 101 by Wonder Blender WB-1 from OSAKA CHEMICAL Co., Ltd. at 25,000 rpm for 10 sec twice to prepare a mixed powder.

The particle diameter distribution of each of the materials was measured by a laser diffraction particle diameter distribution measurer (SALD-2200 from Shimadzu Corp.) and 50% diameter of the number distribution was determined to be a particle diameter.

From the specific gravity, blending ratio and desired filling rate preliminarily measured, an amount of the mixture powder to be placed in a mold was determined. In this example, a protective material block was prepared from the determined amount (g) of the mixed powder with the following procedure.

The mixed powder was placed in an aluminum mold having a depth of 40 mm, a width of 8 mm and a length of 350 mm and compressed by a press such that the filled had a height of 6 mm to consolidate the powder after smoothing the surface of the powder.

The consolidated protective material was taken out from the mold, reformed to 6 mm×8 mm×310 mm, and attached to a metallic substrate to prepare a protective material block 101.

The X-ray diffraction pattern of the protective material block 101 was measured as the protective material block 1 was to determine the ratio (P2/P1).

Protective Material Blocks 102 to 124

The procedure for preparation of the protective material block 101 in Example 101 was repeated except for changing the materials, mixing ratio of the mixture and the amount of input thereof as shown in the following Table 101 to prepare protective material blocks 102 to 124. The X-ray diffraction patterns of the protective material blocks 102 to 123 were measured as the protective material block 1 was to determine the ratios (P2/P1).

The procedure for preparation of the protective material block 101 in Example 101 was repeated except for using melt molding instead of compression molding to prepare a protective material block 124. The X-ray diffraction pattern of the protective material block 124 was measured as the protective material block 1 was to determine the ratio (P2/P1).

A porosity of each of the protective material blocks was measured as follows.

1. 3 pieces of rectangulars of 5 cm×8 mm×8 mm were cut out from the protective material block.

2. The size of the protective material block was measured with a side gauge, and an apparent volume V1 ($cm^3$) including airspace.

3. The weight W1 (g) of the protective material block was measured.

4. The sample was pulverized, and part of which was precisely weighed W2 (g).

5. The pulverized sample was placed in Beckman air comparison densitometer to obtain a volume V3 ($cm^3$) of the protective material W2 (g).

6. The porosity was determined by the following formulae:

$$Porosity\ (\%)=100\times[V1-V2\cdot(W1/W2)]V1\ (\text{volume }\%).$$

The properties were measured under an environment of 20° C. and 50% RH. The continuous bubble fraction and the independent bubble fraction of each of the protective materials are shown in the following Table 101.

TABLE 101

| | | C1 | | | C2 | | | C3 | | | | | | |
|---|---|---|---|---|---|---|---|---|---|---|---|---|---|---|
| | | M | D1 (μm) | WR | M | D2 (μm) | WR | M | D (μm) | WR | Wt (g) | Po (v %) | D2/D1 | P2/P1 |
| Ex. 101 | P101 | MSP | 50 | 80 | BN | 5 | 20 | Al | 0.5 | 5 | 19.2 | 10 | 0.10 | 0.13 |
| Ex. 102 | P102 | MSP | 20 | 80 | BN | 5 | 20 | Al | 0.5 | 5 | 19.2 | 10 | 0.25 | 0.14 |
| Ex. 103 | P103 | MSP | 90 | 80 | BN | 5 | 20 | Al | 0.5 | 5 | 19.2 | 10 | 0.06 | 0.12 |
| Ex. 104 | P104 | MSP | 50 | 80 | BN | 5 | 20 | Al | 0.5 | 5 | 20.6 | 3 | 0.10 | 0.09 |
| Ex. 105 | P105 | MSP | 50 | 80 | BN | 5 | 20 | Al | 0.5 | 5 | 18.1 | 15 | 0.10 | 0.17 |
| Ex. 106 | P106 | MSP | 50 | 80 | BN | 5 | 20 | Al | 0.5 | 5 | 19.1 | 10 | 0.10 | 0.11 |
| Ex. 107 | P107 | MSP | 50 | 80 | BN | 5 | 20 | Al | 0.5 | 5 | 18.8 | 10 | 0.10 | 0.12 |
| Ex. 108 | P108 | MSP | 50 | 80 | BN | 5 | 20 | Al | 0.1 | 5 | 19.2 | 10 | 0.10 | 0.11 |
| Ex. 109 | P109 | MSP | 50 | 80 | BN | 5 | 20 | Al | 1.5 | 5 | 19.2 | 10 | 0.10 | 0.11 |
| Ex. 110 | P110 | MSP | 50 | 80 | BN | 5 | 20 | Al | 0.05 | 5 | 19.2 | 10 | 0.10 | 0.12 |
| Ex. 111 | P111 | MSP | 50 | 80 | BN | 5 | 20 | Al | 2.0 | 5 | 19.2 | 10 | 0.10 | 0.11 |
| Ex. 112 | P112 | MSP | 50 | 80 | BN | 5 | 20 | — | — | — | 18.5 | 10 | 0.10 | 0.11 |
| Ex. 113 | P113 | MSP | 50 | 70 | BN | 5 | 30 | Al | 0.5 | 5 | 20.3 | 10 | 0.10 | 0.12 |
| Ex. 114 | P114 | MSP | 50 | 95 | BN | 5 | 5 | Al | 0.5 | 5 | 17.7 | 10 | 0.10 | 0.13 |
| Ex. 115 | P115 | MSP | 50 | 60 | BN | 5 | 40 | Al | 0.5 | 5 | 21.6 | 10 | 0.10 | 0.12 |
| Ex. 116 | P116 | MSP | 50 | 98 | BN | 5 | 2 | Al | 0.5 | 5 | 17.4 | 10 | 0.10 | 0.11 |
| Ex. 117 | P117 | MSP | 20 | 80 | BN | 0.1 | 20 | Al | 0.5 | 5 | 19.2 | 10 | 0.01 | 0.11 |
| Ex. 118 | P118 | MSP | 90 | 80 | BN | 0.1 | 20 | Al | 0.5 | 5 | 19.2 | 10 | 0.001 | 0.11 |
| Ex. 119 | P119 | MSP | 20 | 80 | BN | 14 | 20 | Al | 0.5 | 5 | 19.2 | 10 | 0.70 | 0.11 |
| Ex. 120 | P120 | MSP | 90 | 80 | BN | 14 | 20 | Al | 0.5 | 5 | 19.2 | 10 | 0.16 | 0.11 |
| Ex. 121 | P121 | MSP | 20 | 80 | BN | 8 | 20 | Al | 0.5 | 5 | 19.2 | 10 | 0.40 | 0.11 |

TABLE 101-continued

| | | C1 | | | C2 | | | C3 | | | | | | |
|---|---|---|---|---|---|---|---|---|---|---|---|---|---|---|
| | | M | D1 (μm) | WR | M | D2 (μm) | WR | M | D (μm) | WR | Wt (g) | Po (v %) | D2/D1 | P2/P1 |
| Ex. 122 | P122 | MSP | 35 | 80 | BN | 14 | 20 | Al | 0.5 | 5 | 19.2 | 10 | 0.40 | 0.11 |
| Ex. 123 | P123 | MSP | 26 | 80 | BN | 11 | 20 | Al | 0.5 | 5 | 19.2 | 10 | 0.42 | 0.11 |
| Com. Ex. 101 | P124 | ZS | — | 80 | BN | 5 | 20 | Al | 0.5 | 5 | 21.3 | 0 | — | 2.2 |

P: Protective material
MSP: Mixture of Zinc stearate and zinc palmitate (69:31)
ZS: Zinc stearate
BN: Boron nitride
Al: Alumina
C1: Constituent 1
C2: Constituent 2
C3: Constituent 3
M: Material
WR: Weight ratio
Wt: Weight
D: Particle diameter
Po: Porosity
v %: volume %

Next, as shown in FIG. 3, around a photoreceptor, following to a transfer process, a counter-type cleaning blade, a brush-shaped protective material applicator using the protective material block 101 and a trailing-type protection layer former are located in this order from upstream to prepare a process cartridge.

The process cartridge was installed in an image forming apparatus (imagio Neo C600 from Ricoh Company, Ltd.) modified to include the process cartridge, and 100,000 pieces of an A4 image having vertical stripe images 5 cm wide having an image area of 50% were continuously produced. The images were evaluated in environments of 20° C. and 50% RH, 10° C. and 25% RH, and 35° C. and 80% RH.

A polymerized toner having a weight-average particle diameter (D4) of 5.1 μm, a number-average particle diameter (D1) of 4.3 μm, a ratio (D4/D1) of 1.19 and average circularity of 0.98 was used.

Striped abnormal images, uneven halftone images and blurred images related to the cleanability were evaluated according to the following standards.

Every 10,000 images were evaluated and the test was stopped when unusable abnormal images were produced.

<Striped Abnormal Images> (St)

◎: Very good
○: Good
Δ: Acceptable
×: Unusable

<Uneven Halftone Images> (UH)

◎: Very good
○: Good
Δ: Acceptable
×: Unusable

<Blurred Images> (Bl)

◎: Very good
○: Good
Δ: Acceptable
×: Unusable

The consumption of the protective material block was determined on the weight, and further the uniformity thereof was visually observed and evaluated according to the following standard.

<Consumption of Protective Material Block>

○: Uniformly consumed
Δ: Slightly different between lateral and background (practically usable)
×: Apparently different between lateral and background (practically unusable)

Further, deterioration of the photoreceptor, the cleaning blade and the charger were observed according to the following standard before and after 100,000 images were produced.

○: Unchanged
Δ: Slightly deteriorated (practically usable)
×: Deteriorated

The photoreceptor, the cleaning blade and the charger did not deteriorate and produced quality images even after producing 100,000 images.

The image evaluation results and the observation results of the deterioration are shown in the following Tables 102 to 105 including the following Examples and Comparative Examples.

In addition, the image forming apparatus using the protective material block 101 continuously produced 500,000 quality images, and the mage bearer, the cleaning blade and the charger hardly deteriorated.

Examples 102 to 123

The procedure for the image evaluation in Example 101 was repeated except for replacing the protective material block 101 with the protective material blocks 102 and 123.

The image evaluation results and the observation results of the deterioration are shown in the following Tables 102 to 105.

Comparative Example 101

The procedure for the image evaluation in Example 101 was repeated except for replacing the protective material block 101 with the protective material block 124.

The image evaluation results and the observation results of the deterioration are shown in the following Tables 102 to 105.

Even when the pressure of the applicator was adjusted to control a provided amount of the protective material, uneven coating thereof was not resolved, resulting in striped abnormal images.

Example 124

Around a photoreceptor, following to a transfer process, a brush-shaped protective material applicator using the protective material block 101 and a counter-type protection layer former combined with a cleaning blade are located in this order from upstream to prepare a process cartridge.

The process cartridge was installed in an image forming apparatus (imagio Neo C455 from Ricoh Company, Ltd.) modified to include the process cartridge, and 100,000 pieces of an A4 image having an image area of 6% were continuously produced.

A polymerized toner having a weight-average particle diameter (D4) of 5.1 μm, a number-average particle diameter (D1) of 4.3 μm, a ratio (D4/D1) of 1.19 and average circularity of 0.98 was used.

Striped abnormal images, uneven halftone images and blurred images related to the cleanability were evaluated as they were in Example 101.

In addition, deterioration of the photoreceptor, the cleaning blade and the charger were observed according to the following standard before and after 100,000 images were produced as they were in Example 101.

As shown in the following Tables 102 to 105, better quality images were produced in Examples 101 to 124 than Comparative Example 101, and the photoreceptor, the cleaning blade and the charger were scarcely deteriorated therein. Further, the protect blocks were stably consumed.

TABLE 102

| | Initial Image | | | | | | | | |
|---|---|---|---|---|---|---|---|---|---|
| | 20° C. 50% RH | | | 10° C. 25% RH | | | 35° C. 80% RH | | |
| | St | UH | Bl | St | UH | Bl | St | UH | Bl |
| Ex. 101 | ◎ | ◎ | ◎ | ◎ | ◎ | ◎ | ◎ | ◎ | ◎ |
| Ex. 102 | ◎ | ◎ | ◎ | ◎ | ◎ | ◎ | ◎ | ◎ | ◎ |
| Ex. 103 | ◎ | ◎ | ◎ | ◎ | ◎ | ◎ | ◎ | ◎ | ◎ |
| Ex. 104 | ◎ | ◎ | ◎ | ◎ | ◎ | ◎ | ◎ | ◎ | ◎ |
| Ex. 105 | ◎ | ◎ | ◎ | ◎ | ◎ | ◎ | ◎ | ◎ | ◎ |
| Ex. 106 | ◎ | ◎ | ◎ | ◎ | ◎ | ◎ | ◎ | ◎ | ◎ |
| Ex. 107 | ◎ | ◎ | ◎ | ◎ | ◎ | ◎ | ◎ | ◎ | ◎ |
| Ex. 108 | ◎ | ◎ | ◎ | ◎ | ◎ | ◎ | ◎ | ◎ | ◎ |
| Ex. 109 | ◎ | ◎ | ◎ | ◎ | ◎ | ◎ | ◎ | ◎ | ◎ |
| Ex. 110 | ◎ | ◎ | ◎ | ◎ | ◎ | ◎ | ◎ | ◎ | ◎ |
| Ex. 111 | ◎ | ◎ | ◎ | ◎ | ◎ | ◎ | ◎ | ◎ | ◎ |
| Ex. 112 | ◎ | ◎ | ◎ | ◎ | ◎ | ◎ | ○ | ◎ | ◎ |
| Ex. 113 | ◎ | ◎ | ◎ | ◎ | ◎ | ◎ | ◎ | ◎ | ◎ |
| Ex. 114 | ◎ | ◎ | ◎ | ◎ | ◎ | ◎ | ◎ | ◎ | ◎ |
| Ex. 115 | ◎ | ◎ | ◎ | ◎ | ◎ | ◎ | ○ | ◎ | ◎ |
| Ex. 116 | ◎ | ◎ | ◎ | ◎ | ◎ | ◎ | ◎ | ◎ | ◎ |
| Ex. 117 | ◎ | ◎ | ◎ | ◎ | ◎ | ◎ | ◎ | ◎ | ◎ |
| Ex. 118 | ◎ | ◎ | ◎ | ◎ | ◎ | ◎ | ◎ | ◎ | ◎ |
| Ex. 119 | ◎ | ◎ | ◎ | ◎ | ◎ | ◎ | ◎ | ○ | ◎ |
| Ex. 120 | ◎ | ◎ | ◎ | ◎ | ◎ | ◎ | ◎ | ◎ | ◎ |
| Ex. 121 | ◎ | ◎ | ◎ | ◎ | ◎ | ◎ | ◎ | ◎ | ◎ |
| Ex. 122 | ◎ | ◎ | ◎ | ◎ | ◎ | ◎ | ◎ | ◎ | ◎ |
| Ex. 123 | ◎ | ◎ | ◎ | ◎ | ◎ | ◎ | ◎ | ◎ | ◎ |
| Ex. 124 | ◎ | ◎ | ◎ | ◎ | ◎ | ◎ | ◎ | ◎ | ◎ |
| Com. Ex. 101 | ◎ | ◎ | ◎ | ◎ | ◎ | ◎ | ◎ | ○ | ◎ |

TABLE 103

| | After 100,000 | | | | | | | | | |
|---|---|---|---|---|---|---|---|---|---|---|
| | 20° C. 50% RH | | | 10° C. 25% RH | | | 35° C. 80% RH | | | |
| | St | UH | Bl | St | UH | Bl | St | UH | Bl | NI |
| Ex. 101 | ◎ | ◎ | ◎ | ◎ | ◎ | ◎ | ◎ | ◎ | ◎ | 100k |
| Ex. 102 | ◎ | ◎ | ◎ | ○ | ○ | ◎ | ◎ | ◎ | Δ | 100k |
| Ex. 103 | ◎ | ◎ | ◎ | Δ | ◎ | ◎ | ◎ | ◎ | ◎ | 100k |
| Ex. 104 | ◎ | ◎ | ◎ | ○ | ◎ | ◎ | ◎ | ◎ | ◎ | 100k |
| Ex. 105 | ◎ | ◎ | ◎ | ◎ | ◎ | ◎ | ◎ | ◎ | ○ | 100k |
| Ex. 106 | ◎ | ◎ | ◎ | ◎ | ◎ | ◎ | ◎ | ○ | ○ | 100k |
| Ex. 107 | ◎ | ◎ | ◎ | ○ | ◎ | ◎ | ◎ | ◎ | ◎ | 100k |
| Ex. 108 | ◎ | ◎ | ◎ | ◎ | ○ | ◎ | ◎ | ◎ | ○ | 100k |
| Ex. 109 | ○ | ◎ | ◎ | ○ | ◎ | ◎ | ○ | ◎ | ◎ | 100k |

TABLE 103-continued

| | After 100,000 | | | | | | | | | |
|---|---|---|---|---|---|---|---|---|---|---|
| | 20° C. 50% RH | | | 10° C. 25% RH | | | 35° C. 80% RH | | | |
| | St | UH | Bl | St | UH | Bl | St | UH | Bl | NI |
| Ex. 110 | ◎ | ◎ | ◎ | ◎ | ○ | ◎ | ◎ | ○ | Δ | 100k |
| Ex. 111 | ○ | ◎ | ◎ | ◎ | ◎ | ◎ | ○ | ◎ | ◎ | 100k |
| Ex. 112 | ◎ | ○ | ◎ | ◎ | Δ | ◎ | ◎ | Δ | Δ | 100k |
| Ex. 113 | ◎ | ◎ | ◎ | ◎ | ◎ | ◎ | ◎ | ◎ | ○ | 100k |
| Ex. 114 | ○ | ◎ | ◎ | ○ | ◎ | ◎ | ◎ | ◎ | ◎ | 100k |
| Ex. 115 | ◎ | ○ | ○ | ◎ | ◎ | ◎ | ○ | ◎ | Δ | 100k |
| Ex. 116 | Δ | ◎ | ◎ | Δ | ◎ | ◎ | ◎ | ◎ | ◎ | 100k |
| Ex. 117 | ◎ | ◎ | ◎ | ◎ | ◎ | ◎ | ◎ | ◎ | ○ | 100k |
| Ex. 118 | ◎ | ◎ | ◎ | ○ | ◎ | ◎ | ◎ | ◎ | ◎ | 100k |
| Ex. 119 | ◎ | ○ | ◎ | ○ | Δ | ◎ | ◎ | Δ | Δ | 100k |
| Ex. 120 | ◎ | ◎ | ◎ | Δ | ◎ | ◎ | ◎ | ◎ | ◎ | 100k |
| Ex. 121 | ◎ | ◎ | ◎ | ◎ | ◎ | ◎ | ◎ | ◎ | Δ | 100k |
| Ex. 122 | ◎ | ◎ | ◎ | ○ | ○ | ◎ | ◎ | Δ | ○ | 100k |
| Ex. 123 | ◎ | ○ | ◎ | ◎ | ○ | ◎ | ◎ | ◎ | ○ | 100k |
| Ex. 124 | ◎ | ◎ | ◎ | ○ | ◎ | ◎ | ◎ | ◎ | Δ | 100k |
| Com. Ex. 101 | X | ○ | ◎ | X | X | ◎ | Δ | Δ | ◎ | 20k |

NI: The number of images produces when the test was finished

TABLE 104

| | CAP (g) | | | | | | Protective material |
|---|---|---|---|---|---|---|---|
| | 10k | 20k | 30k | 50k | 70k | 100k | Consumption |
| Ex. 101 | 0.51 | 0.90 | 1.37 | 2.29 | 3.23 | 4.50 | ○ |
| Ex. 102 | 0.71 | 1.34 | 1.99 | 3.31 | 4.60 | 6.55 | ○ |
| Ex. 103 | 0.30 | 0.69 | 0.95 | 1.58 | 2.10 | 3.07 | ○ |
| Ex. 104 | 0.47 | 0.87 | 1.28 | 2.05 | 2.81 | 4.03 | ○ |
| Ex. 105 | 0.57 | 1.10 | 1.68 | 2.79 | 3.92 | 5.53 | ○ |
| Ex. 106 | 0.45 | 0.91 | 1.35 | 2.26 | 3.20 | 4.57 | ○ |
| Ex. 107 | 0.52 | 0.97 | 1.41 | 2.34 | 3.23 | 4.57 | ○ |
| Ex. 108 | 0.39 | 0.65 | 0.98 | 1.61 | 2.25 | 3.16 | ○ |
| Ex. 109 | 0.53 | 0.94 | 1.48 | 2.37 | 3.38 | 4.75 | ○ |
| Ex. 110 | 0.32 | 0.50 | 0.73 | 1.23 | 1.77 | 2.44 | ○ |
| Ex. 111 | 0.49 | 1.01 | 1.52 | 2.40 | 3.36 | 4.81 | Δ |
| Ex. 112 | 0.41 | 0.89 | 1.32 | 2.13 | 2.93 | 4.15 | ○ |
| Ex. 113 | 0.60 | 1.07 | 1.59 | 2.74 | 3.75 | 5.36 | ○ |
| Ex. 114 | 0.52 | 0.90 | 1.32 | 2.20 | 3.10 | 4.46 | ○ |
| Ex. 115 | 0.60 | 1.18 | 1.69 | 2.82 | 3.88 | 5.53 | ○ |
| Ex. 116 | 0.42 | 0.88 | 1.27 | 2.10 | 3.02 | 4.29 | ○ |
| Ex. 117 | 0.55 | 1.01 | 1.44 | 2.35 | 3.29 | 4.76 | ○ |
| Ex. 118 | 0.43 | 0.87 | 1.30 | 2.14 | 3.01 | 4.26 | Δ |
| Ex. 119 | 0.55 | 1.03 | 1.43 | 2.40 | 3.33 | 4.73 | ○ |
| Ex. 120 | 0.44 | 0.90 | 1.27 | 2.17 | 3.02 | 4.27 | Δ |
| Ex. 121 | 0.49 | 0.98 | 1.47 | 2.41 | 3.31 | 4.70 | ○ |
| Ex. 122 | 0.45 | 0.94 | 1.35 | 2.26 | 3.19 | 4.59 | Δ |
| Ex. 123 | 0.50 | 0.97 | 1.39 | 2.33 | 3.28 | 4.64 | ○ |
| Ex. 124 | 0.43 | 0.94 | 1.29 | 2.16 | 3.08 | 4.36 | Δ |
| Com. Ex. 101 | 0.12 | 0.13 | — | — | — | — | Δ |

CAP: Consumed amount of protective material

TABLE 105

| | After 100,000 | | |
|---|---|---|---|
| | Photoreceptor | Cleaner | Charger |
| Example 101 | ○ | ○ | ○ |
| Example 102 | ○ | ○ | ○ |
| Example 103 | ○ | ○ | ○ |
| Example 104 | ○ | ○ | ○ |
| Example 105 | ○ | ○ | ○ |
| Example 106 | ○ | ○ | ○ |
| Example 107 | ○ | Δ | ○ |
| Example 108 | Δ | ○ | ○ |
| Example 109 | ○ | Δ | ○ |
| Example 110 | Δ | ○ | ○ |

TABLE 105-continued

| | After 100,000 | | |
|---|---|---|---|
| | Photoreceptor | Cleaner | Charger |
| Example 111 | Δ | Δ | ○ |
| Example 112 | Δ | ○ | Δ |
| Example 113 | Δ | ○ | ○ |
| Example 114 | ○ | Δ | ○ |
| Example 115 | Δ | Δ | ○ |
| Example 116 | ○ | Δ | Δ |
| Example 117 | ○ | ○ | ○ |
| Example 118 | Δ | ○ | ○ |
| Example 119 | Δ | Δ | ○ |
| Example 120 | Δ | Δ | ○ |
| Example 121 | Δ | ○ | ○ |
| Example 122 | Δ | ○ | ○ |
| Example 123 | Δ | Δ | ○ |
| Example 124 | Δ | ○ | ○ |
| Comparative Example 101 | X | X | Δ |

Example 201

Constituents 1 to 2 shown in Table 201 and 202 were mixed by Wonder Blender WB-1 from OSAKA CHEMICAL Co., Ltd. at 25,000 rpm for 5 sec twice to prepare a mixture, and constituent 3 shown in Table 201 was further mixed with mixture thereby at 25,000 rpm for 5 sec once to prepare a mixed powder.

From the specific gravity, blending ratio and desired filling rate preliminarily measured, an amount of the mixture powder to be placed in a mold was determined. In this example, a protective material block was prepared from 25.2 g of the mixed powder with the following procedure such that the filling rate was 90% by volume (porosity 10% by volume).

The mixed powder was placed in an aluminum mold having a depth of 20 mm, a width of 8 mm and a length of 350 mm, and oscillated to be even with a lid so as not to leak. The powder was compressed by a press such that the filled had a height of 8 mm to consolidate the powder after taking out of the lid.

The consolidated protective material was taken out from the mold, reformed to 8 mm×8 mm×310 mm, and attached to a metallic substrate to prepare a protective material block 201.

The X-ray diffraction pattern of the protective material block 201 was measured as the protective material block 1 was to determine the ratio (P2/P1).

Examples 202 to 209 and Comparative Example 201

Protective Material Blocks 202 to 209

The procedure for preparation of the protective material block 101 in Example 201 was repeated except for changing the materials, mixing ratio of the mixture and the amount of input thereof as shown in the following Table 201 to prepare protective material blocks 202 to 209.

The procedure for preparation of the protective material block 201 in Example 201 was repeated except for using melt molding instead of compression molding such that the porosity was 0 to prepare a protective material block 210. The X-ray diffraction patterns of the protective material blocks 202 to 210 were measured as the protective material block 1 was to determine the ratio (P2/P1).

The bending strength of the protective material blocks 202 to 210 was measured by the following procedure.

1. Each 2 rolls of the protective material blocks 202 to 210 were cut to 5 rolls to prepare 10 rolls of sample test chip having a size of 6 cm×8 mm×8 mm.

2. Each three points of the thickness and width were measured by a slide gauge to determined an average thickness d [mm] and an average width w [mm].

3. The sample test chip was set in a three-point bending tester having a distance between supporting points L of 40 mm, and the test chip was gradually loaded until broken and a load F [g] when broken was recorded.

The loads exceeding 8,000 g were censored data.

The w, d and L were placed in the formula (2), and the break strength of each sample test chip [N/mm$^2$] was determined.

4. 2 and 3 were repeated for the 10 rolls of sample test chip to determine a scale parameter η and a shape parameter m.

Next, around a photoreceptor having an outermost surface layer including a heat radical reaction type multifunctional acrylic resin as a thermosetting resin, following to a transfer process, a counter-type cleaning blade, a brush-shaped protective material applicator using the protective material block 201 and a trailing-type protection layer former are located in this order from upstream to prepare a process cartridge.

The process cartridge was installed in an image forming apparatus (imagio Neo C600 from Ricoh Company, Ltd.) modified to include the process cartridge, and 100,000 pieces of an A4 image having an image area of 6% were continuously produced. The images were evaluated in environments of 20° C. and 50% RH, 10° C. and 25% RH, and 35° C. and 80% RH.

A polymerized toner having a weight-average particle diameter (D4) of 5.2 μm, a number-average particle diameter (D1) of 4.5 μm, a ratio (D4/D1) of 1.16 and average circularity of 0.98 was used.

Striped abnormal images, uneven halftone images, background development and blurred images related to the cleanability were evaluated according to the following standards. The results are shown in Tables 203 and 204.

<Striped Abnormal Images> (St)

◎: Very good
○: Good
Δ: Acceptable
×: Unusable

<Uneven Halftone images> (UH)

◎: Very good
○: Good
Δ: Acceptable
×: Unusable

<Background Development> (BD)

◎: very good
○: Good
Δ: Acceptable
×: Unusable

<Blurred Images> (Bl)

◎: very good
○: Good
Δ: Acceptable
×: Unusable

The consumption of the protective material block was determined on the weight, and further the uniformity thereof was visually observed and evaluated according to the following standard. The results are shown in Table 205.

<Consumption of Protective Material Block>

◎: Uniformly consumed
○: Partially and deeply consumed (1 or 2 parts)
Δ: Deeply and dottedly consumed (5 parts or more, but practically usable)
×: Nonuniformly consumed Further, deterioration of the image bearer, the cleaning blade and the charger were observed according to the following standard before and after 100,000 images were produced. The results are shown in Table 206.

○: Unchanged
Δ: Slightly deteriorated (practically usable)
×: Deteriorated

TABLE 201

| | | C1 | | C2 | | C3 | | | Wt | | | Po | |
|---|---|---|---|---|---|---|---|---|---|---|---|---|---|
| | | M | VR | M | VR | M | D (μm) | WR | (g) | η | m | (%) | P2/P1 |
| Ex. 201 | P201 | FT | 70 | MSP | 20 | Al | 0.3 | 10 | 252.0 | 2.0 | 11.0 | 10 | 0.18 |
| Ex. 202 | P202 | FT | 80 | MSP | 30 | ENR | 0.1 | 10 | 202.0 | 2.6 | 10.2 | 10 | 0.14 |
| Ex. 203 | P203 | FT | 70 | MSP | 20 | Al | 0.3 | 10 | 20.2 | 3.2 | 14.0 | 3 | 0.11 |
| Ex. 204 | P204 | FT | 70 | MSP | 20 | Al | 0.3 | 10 | 23.8 | 1.2 | 5.2 | 15 | 0.22 |
| Ex. 205 | P205 | FT | 70 | MSP | 20 | Al | 2 | 10 | 25.2 | 1.8 | 10.0 | 10 | 0.11 |
| Ex. 206 | P206 | FT | 70 | MSP | 20 | HS | 0.1 | 10 | 21.4 | 2.4 | 11.9 | 10 | 0.11 |
| Ex. 207 | P207 | FT | 70 | MSP | 20 | Al | 3 | 10 | 25.2 | 1.8 | 9.7 | 10 | 0.12 |
| Ex. 208 | P208 | FT | 70 | MSP | 20 | HS | 0.02 | 10 | 21.4 | 2.6 | 12.0 | 10 | 0.11 |
| Ex. 209 | P209 | FT | 80 | MSP | 20 | — | — | 0 | 19.8 | 1.8 | 11.1 | 10 | 0.13 |
| Com. Ex. 201 | P210 | FT | 70 | ZS | 20 | Al | 0.3 | 10 | 28.0 | 12.4 | 16.9 | 0 | 2.2 |

P: Protective material
FT: Fischer-Tropsch wax having a melting point of 105° C.
FT2: Fischer-Tropsch wax having a melting point of 125° C.
MSP: Mixture of Zinc stearate and zinc palmitate (60:40)
ZS: Zinc stearate
Al: Alumina
ENR: Ethylene-norbornene resin
HS: Hydrophobic silica
C1: Constituent 1
C2: Constituent 2
C3: Constituent 3
M: Material
VR: Volume ratio
WR: Weight ratio
Wt: Weight
D: Particle diameter
Po: Porosity

TABLE 202

| Name | True specific gravity |
|---|---|
| Fischer-Tropsch wax | 0.95 |
| Mixture of Zinc stearate and zinc palmitate (60:40) | 1.1 |
| Zinc stearate | 1.1 |

TABLE 202-continued

| Name | True specific gravity |
|---|---|
| Alumina | 3.64 |
| Ethylene-norbornene resin | 1.01 |
| Hydrophobic silica | 1.76 |

TABLE 203

| Initial Image | 20° C. 50% RH | | | | 10° C. 25% RH | | | | 35° C. 80% RH | | | |
|---|---|---|---|---|---|---|---|---|---|---|---|---|
| | St | UH | BD | Bl | St | UH | BD | Bl | St | UH | BD | Bl |
| Ex. 201 | ◎ | ◎ | ◎ | ◎ | ◎ | ◎ | ◎ | ◎ | ◎ | ◎ | ◎ | ◎ |
| Ex. 202 | ◎ | ◎ | ◎ | ◎ | ◎ | ◎ | ◎ | ◎ | ◎ | ◎ | ◎ | ◎ |
| Ex. 203 | ◎ | ◎ | ◎ | ◎ | ◎ | ◎ | ◎ | ◎ | ◎ | ◎ | ◎ | ◎ |
| Ex. 204 | ◎ | ◎ | ◎ | ◎ | ◎ | ◎ | ◎ | ◎ | ◎ | ◎ | ◎ | ◎ |
| Ex. 205 | ◎ | ◎ | ◎ | ◎ | ◎ | ◎ | ◎ | ◎ | ◎ | ◎ | ◎ | ◎ |
| Ex. 206 | ◎ | ◎ | ◎ | ◎ | ◎ | ◎ | ◎ | ◎ | ◎ | ◎ | ◎ | ◎ |
| Ex. 207 | ◎ | ◎ | ◎ | ◎ | ◎ | ◎ | ◎ | ◎ | ◎ | ◎ | ◎ | ◎ |
| Ex. 208 | ◎ | ◎ | ◎ | ◎ | ◎ | ◎ | ◎ | ◎ | ◎ | ◎ | ◎ | ◎ |
| Ex. 209 | ◎ | ◎ | ◎ | ◎ | ◎ | ○ | ◎ | ◎ | ◎ | ○ | ◎ | ◎ |
| Com. Ex. 201 | ◎ | ◎ | ◎ | ◎ | Δ | ◎ | ◎ | ◎ | ◎ | ◎ | ◎ | ◎ |

TABLE 204

| After 100,000 | 20° C. 50% RH | | | | 10° C. 25% RH | | | | 35° C. 80% RH | | | | |
|---|---|---|---|---|---|---|---|---|---|---|---|---|---|
| | St | UH | BD | Bl | St | UH | BD | Bl | St | UH | BD | Bl | PC |
| Ex. 201 | ◎ | ◎ | ◎ | ◎ | ◎ | ◎ | ◎ | ◎ | ◎ | ◎ | ◎ | ◎ | ◎ |
| Ex. 202 | ◎ | ◎ | ◎ | ◎ | ◎ | ◎ | ◎ | ◎ | ◎ | ◎ | ◎ | ◎ | ◎ |
| Ex. 203 | ◎ | ○ | ◎ | ◎ | ◎ | ○ | ◎ | ◎ | ◎ | ○ | ◎ | ○ | ◎ |

TABLE 204-continued

| | After 100,000 | | | | | | | | | | | | |
|---|---|---|---|---|---|---|---|---|---|---|---|---|---|
| | 20° C. 50% RH | | | | 10° C. 25% RH | | | | 35° C. 80% RH | | | | |
| | St | UH | BD | Bl | St | UH | BD | Bl | St | UH | BD | Bl | PC |
| Ex. 204 | ○ | ○ | ◎ | ◎ | ○ | ○ | ◎ | ◎ | ◎ | ◎ | ◎ | ◎ | ○ |
| Ex. 205 | ○ | ◎ | ◎ | ◎ | ○ | ◎ | ◎ | ◎ | ◎ | ◎ | ○ | ◎ | ◎ |
| Ex. 206 | ◎ | ○ | ◎ | ◎ | ○ | ○ | ◎ | ◎ | ◎ | ○ | ○ | ◎ | ◎ |
| Ex. 207 | ◎ | ◎ | ◎ | ◎ | ○ | ◎ | ◎ | ◎ | ◎ | ◎ | ○ | ◎ | ◎ |
| Ex. 208 | ◎ | ○ | ◎ | ◎ | Δ | Δ | ◎ | ◎ | ◎ | Δ | ○ | ◎ | ◎ |
| Ex. 209 | ◎ | ○ | ◎ | ◎ | ○ | Δ | ◎ | ◎ | ◎ | Δ | ○ | ○ | ○ |
| Com. Ex. 201 | X | Δ | Δ | Δ | Δ | Δ | Δ | Δ | Δ | Δ | X | X | ◎ |

PC: Protective material consumption

TABLE 205

| | CAP (g) | | | | | | Protective material |
|---|---|---|---|---|---|---|---|
| | 10k | 20k | 30k | 50k | 70k | 100k | Consumption |
| Ex. 201 | 0.51 | 0.90 | 1.37 | 2.29 | 3.23 | 4.50 | ○ |
| Ex. 202 | 0.71 | 1.34 | 1.99 | 3.31 | 4.60 | 6.55 | ○ |
| Ex. 203 | 0.30 | 0.69 | 0.95 | 1.58 | 2.10 | 3.07 | ○ |
| Ex. 204 | 0.47 | 0.87 | 1.28 | 2.05 | 2.81 | 4.03 | ○ |
| Ex. 205 | 0.45 | 0.91 | 1.35 | 2.26 | 3.20 | 4.57 | ○ |
| Ex. 206 | 0.52 | 0.97 | 1.41 | 2.34 | 3.23 | 4.57 | ○ |
| Ex. 207 | 0.39 | 0.65 | 0.98 | 1.61 | 2.25 | 3.16 | ○ |
| Ex. 208 | 0.53 | 0.94 | 1.48 | 2.37 | 3.38 | 4.75 | ○ |
| Ex. 209 | 0.32 | 0.50 | 0.73 | 1.23 | 1.77 | 2.44 | ○ |
| Com. Ex. 201 | 0.79 | 1.44 | — | — | — | — | X |

CAP: Consumed amount of protective material

TABLE 206

| | After 10,000 | | |
|---|---|---|---|
| | Photoreceptor | Cleaner | Charger |
| Example 201 | ○ | ○ | ○ |
| Example 202 | ○ | ○ | ○ |
| Example 203 | Δ | Δ | ○ |
| Example 204 | Δ | ○ | Δ |
| Example 205 | Δ | ○ | ○ |
| Example 206 | Δ | ○ | ○ |
| Example 207 | Δ | ○ | ○ |
| Example 208 | Δ | ○ | Δ |
| Example 209 | Δ | Δ | Δ |
| Comparative Example 201 | X | X | Δ |

This application claims priority and contains subject matter related to Japanese Patent Application No. 2008-121141, filed on May 7, 2008, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A protective material block comprising a metal soap, wherein the surface of the protective material block has an X-ray diffraction pattern wherein a ratio (P2 /P1) of a maximum peak height (P2) on a surface separation of from 3.6 to 5.0 Å to a maximum peak height (P1) on a surface separation of from 11 to 16 Å not greater than 0.5.

2. The protective material block of claim 1, wherein the metal soap comprises zinc stearate, zinc palmitate or a mixture of the zinc stearate and zinc palmitate.

3. The protective material block of claim 2, wherein a weight ratio of the zinc stearate to the zinc palmitate is 75/25 to 40/60.

4. The protective material block of claim 1, further comprising boron nitride in an amount of from 1 to 25% by weight.

5. The protective material block of claim 1, further comprising a cracked surface comprising a cleavage surface when craked.

6. The protective material block of claim 5, the cracked surface comprises the cleavage surfaces having an area of from 10 to 10,000 $\mu m^2$ in an area not less than 50%.

7. The protective material block of claim 1, wherein the protective material block is a porous body comprising a continuous bubble fraction of from 3 to 15% by volume and an independent bubble fraction of from 0 to 1% by volume.

8. The protective material block of claim 1, wherein the protective material block is formed of a mixed and consolidated powder comprising a metal soap powder having a number-average particle diameter Da of from 20 to 90 μm and a solid lubricant powder, and the protective material block has a porosity of from 3 to 15% by volume.

9. The protective material block of claim 1, wherein a ratio (Db/Da) of a number-average particle diameter Db of the solid lubricant powder of from 0.1 to 14 to the number-average particle diameter Da of the metal soap powder is greater than 0 and not greater than 0.4.

10. The protective material block of claim 1, wherein the following relationships are satisfied:

$$1.20 \leqq \eta \leqq 3.20 \text{ [N/mm}^2\text{]}$$

$$5 \leqq m \leqq 15$$

$$3 \leqq \Phi \leqq 15 \text{ [\% by volume]}$$

wherein η is a scale parameter and m is a shape parameter determined by wild-plotting break strength when the protective material block is subjected to a three-point bend test, and Φ is a porosity of the protective material block.

11. An image forming apparatus, comprising an applicator configured to press a brush to a protective material block comprising a metal soap to pulverize the protective material and apply the pulverized protective material to a photoreceptor while expanding the pulverized protective material with a blade, wherein the surface of the protective material block has an X-ray diffraction pattern wherein a ratio (P2/P1) of a maximum peak height (P2) on a surface separation of from 3.6 to 5.0 Å to a maximum peak height (P1) on a surface separation of from 11 to 16 Å not greater than 0.5.

12. The image forming apparatus of claim 11, wherein the metal soap comprises zinc stearate, zinc palmitate or a mixture of the zinc stearate and zinc palmitate.

13. The image forming apparatus of claim 12, wherein a weight ratio of the zinc stearate to the zinc palmitate is 75/25 to 40/60.

14. The image forming apparatus of claim 11, wherein the protective material block further comprises boron nitride in an amount of from 1 to 25% by weight.

15. The image forming apparatus of claim 11, wherein the protective material block further comprises a cracked surface comprising a cleavage surface.

16. The image forming apparatus of claim 15, wherein the cracked surface comprises the cleavage surfaces having an area of from 10 to 10,000 $\mu m^2$ in an area not less than 50%.

17. The image forming apparatus of claim 11, wherein the protective material block is a porous body comprising a continuous bubble fraction of from 3 to 15% by volume and an independent bubble fraction of from 0 to 1% by volume.

18. The image forming apparatus of claim 11, the protective material block is formed of a mixed and consolidated powder comprising a metal soap powder having a number-average particle diameter Da of from 20 to 90 μm and a solid lubricant powder, and the protective material block has a porosity of from 3 to 15% by volume.

19. The image forming apparatus of claim 18, a ratio (Db/Da) of a number-average particle diameter Db of the solid lubricant powder of from 0.1 to 14 to the number-average particle diameter Da of the metal soap powder is greater than 0 and not greater than 0.4.

20. The image forming apparatus of claim 11, wherein the protective material block satisfies the following relationships:

$$1.20 \leqq \eta \leqq 3.20 \text{ [N/mm}^2\text{]}$$

$$5 \leqq m \leqq 15$$

$$3 \leqq \Phi \leqq 15 \text{ [\% by volume]}$$

wherein η is a scale parameter and m is a shape parameter determined by wild-plotting break strength when the protective material block is subjected to a three-point bend test, and Φ is a porosity of the protective material block.

* * * * *